US007729903B2

(12) United States Patent
Schuller et al.

(10) Patent No.: US 7,729,903 B2
(45) Date of Patent: Jun. 1, 2010

(54) AUDIO CODING

(76) Inventors: Gerald Schuller, Leopoldstrasse 13, 99089 Erfurt (DE); Stefan Wabnik, Unterpoerlitzer Strasse 58, 98693 Ilmenau (DE); Marc Gayer, Haagstrasse 32, 91054 Erlangen (DE)

( * ) Notice: Subject to any disclaimer, the term of this patent is extended or adjusted under 35 U.S.C. 154(b) by 948 days.

(21) Appl. No.: 11/460,425

(22) Filed: Jul. 27, 2006

(65) Prior Publication Data

US 2007/0016403 A1 Jan. 18, 2007

Related U.S. Application Data

(63) Continuation of application No. PCT/EP2005/001350, filed on Feb. 10, 2005.

(30) Foreign Application Priority Data

Feb. 13, 2004 (DE) ..... 10 2004 007 200

(51) Int. Cl.
*G10L 19/00* (2006.01)

(52) U.S. Cl. ..... 704/200.1; 704/500; 704/501; 704/502; 704/503; 704/504

(58) Field of Classification Search ..... 704/200.1, 704/500, 501, 503, 504, 502
See application file for complete search history.

(56) References Cited

U.S. PATENT DOCUMENTS 5,581,653 A * 12/1996 Todd ..... 704/229
5,845,243 A * 12/1998 Smart et al. ..... 704/200.1
6,115,688 A * 9/2000 Brandenburg et al. ..... 704/503
6,370,477 B1 4/2002 Vermeer
6,675,144 B1 * 1/2004 Tucker et al. ..... 704/264
2004/0019492 A1 * 1/2004 Tucker et al. ..... 704/500

FOREIGN PATENT DOCUMENTS

DE 38 20 038 A1 12/1989

(Continued)

OTHER PUBLICATIONS

Edler, B. et al; "Perceptual Audio Coding Using a Time-Varying Linear Pre- and Post-Filter"; Proceedings of the AES 109$^{th}$ Convention; Los Angeles, California; Sep. 22-25, 2000.

(Continued)

*Primary Examiner*—Qi Han
(74) *Attorney, Agent, or Firm*—Daniel J. Santos

(57) ABSTRACT

The central idea of the present invention is that the prior procedure, namely interpolation relative to the filter coefficients and the amplification value, for obtaining interpolated values for the intermediate audio values starting from the nodes has to be dismissed. Coding containing less audible artifacts can be obtained by not interpolating the amplification value, but rather taking the power limit derived from the masking threshold, for each node, i.e. for each parameterization to be transferred, and then performing the interpolation between these power limits of neighboring nodes, such as, for example, a linear interpolation. On both the coder and the decoder side, an amplification value can then be calculated from the intermediate power limit determined such that the quantizing noise caused by quantization, which has a constant frequency before post-filtering on the decoder side, is below the power limit or corresponds thereto after post-filtering.

18 Claims, 12 Drawing Sheets

FOREIGN PATENT DOCUMENTS

| | | | |
|---|---|---|---|
| DE | 696 19 555 | T2 | 10/2002 |
| EP | 0 346 635 | B1 | 5/1989 |
| EP | 1 160 770 | A2 | 12/2001 |
| EP | 0 950 238 | B1 | 9/2003 |
| WO | WO 00/63886 | A | 10/2000 |
| WO | WO 01/33718 | A1 | 5/2001 |

OTHER PUBLICATIONS

Edler, B. et al.; "Audio Coding Using a Psychoacoustic Pre- and Post-Filter"; Acoustics, Speech, and Signal Processing; 2000; USA.
Bayless, J. et al.; "Voice signals: bit-by-bit"; IEEE Spectrum; Oct. 1973; pp. 28-34; USA.
Caine, C. et al.; "NICAM 3: near-instantaneously companded digital transmission system for high-quality sound programmes"; The Radio and Electronic Engineer; Oct. 1980; vol. 50, No. 10; pp. 519-530.
Schuller, G. et al.; "Perceptual Audio Coding Using Adaptive Pre- and Post-Filters and Lossless Compression"; IEEE Transactions on Speech and Audio Processing; Sep. 2002; vol. 10, No. 6; pp. 379-390; New York, USA.
Kokes, M. et al.; "A Wideband Speech Codec Based on Nonlinear Approximation"; Signals, Systems and Computers; 2001; Conference Record of the Thirty-Fifth Asilomar Conference; vol. 2, Nov. 4-7, 2001; pp. 1573-1577.
Juin-Hwey, Chen; "A High-Fidelity Speech and Audio CODEC With Low Delay and Low Complexity"; Acoustics, Speech, and Signal Processing, 2000; ICASSP '00 Proceedings; 2000 IEEE International Conference on Jun. 5-9, 2000; Piscataway, NJ, USA; IEEE, vol. 2; Jun. 5, 2000.
Adoul, J.P.; "Backward Adaptive Reencoding: A Technique for Reducing the Bit Rate of μ-Law PCM Transmissions"; IEEE Transactions on Communications; vol. COM-30, No. 4; Apr. 1982; pp. 581-592.
Noll, Peter; "Über einige Eigenschaften von Differenz-PCM-Systemen"; AEÜ: vol. 30, No. 3; 1976; pp. 125-130.
Held, Gilbert et al.; "Data Compression"; Book; Second Edition; ISBN: 0471912808; 1987; pp. 84-85; Published by John Wiley & Sons.
English-language Abstract for EP0346635, May 18, 1989, ANT Nachrichtentechnik.

* cited by examiner

BLOCK 0
BLOCK 1
BLOCK 2
56
54
90
92
88
90
84
81
82
DIRECT APPLICATION
LINEAR INTERPOLATION
LINEAR INTERPOLATION
INTERPOLATION 130
132
134
t
SIDE INFORMATION
MAIN DATA
SIDE INFORMATION

AUDIO CODING

CROSS-REFERENCE TO RELATED APPLICATION

This application is a continuation of copending International Application No. PCT/EP2005/001350, filed Feb. 10, 2005, which designated the United States and was not published in English, and is incorporated herein by reference in its entirety, and which claimed priority to German Patent Application No. 102004007200.0, filed on Feb. 13, 2004.

BACKGROUND OF THE INVENTION

1. Field of the Invention

The present invention relates to audio coding in general and, in particular, to audio coding allowing audio signals to be coded with a short delay time.

2. Description of the Related Art

The audio compression method best known at present is MPEG-1 Layer III. With this compression method, the sample or audio values of an audio signal are coded into a coded signal in a lossy manner. Put differently, irrelevance and redundancy of the original audio signal are reduced or ideally removed when compressing. In order to achieve this, simultaneous and temporal maskings are recognized by a psycho-acoustic model, i.e. a temporally varying masking threshold depending on the audio signal is calculated or determined indicating from which volume on tones of a certain frequency are perceivable for human hearing. This information in turn is used for coding the signal by quantizing the spectral values of the audio signal in a more precise or less precise manner or not at all, depending on the masking threshold, and integrating same into the coded signal.

Audio compression methods, such as, for example, the MP3 format, experience a limit in their applicability when audio data is to be transferred via a bit rate-limited transmission channel in a, on the one hand, compressed manner, but, on the other hand, with as small a delay time as possible. In some applications, the delay time does not play a role, such as, for example, when archiving audio information. Small delay audio coders, which are sometimes referred to as "ultra low delay coders", however, are necessary where time-critical audio signals are to be transmitted, such as, for example, in tele-conferencing, in wireless loudspeakers or microphones. For these fields of application, the article by Schuller G. et al. "Perceptual Audio Coding using Adaptive Pre-and Post-Filters and Lossless Compression", IEEE Transactions on Speech and Audio Processing, vol. 10, no. 6, September 2002, pp. 379-390, suggests audio coding where the irrelevance reduction and the redundancy reduction are not performed based on a single transform, but on two separate transforms.

The principle will be discussed subsequently referring to FIGS. 12 and 13. Coding starts with an audio signal 902 which has already been sampled and is thus already present as a sequence 904 of audio or sample values 906, wherein the temporal order of the audio values 906 is indicated by an arrow 908. A listening threshold is calculated by means of a psycho-acoustic model for successive blocks of audio values 906 characterized by an ascending numeration by "block#". FIG. 13, for example, shows a diagram where, relative to the frequency f, graph a plots the spectrum of a signal block of 128 audio values 906 and b plots the masking threshold, as has been calculated by a psycho-acoustic model, in logarithmic units. The masking threshold indicates, as has already been mentioned, up to which intensity frequencies remain inaudible for the human ear, namely all tones below the masking threshold b. Based on the listening thresholds calculated for each block, an irrelevance reduction is achieved by controlling a parameterizable filter, followed by a quantizer. For a parameterizable filter, a parameterization is calculated such that the frequency response thereof corresponds to the inverse of the magnitude of the masking threshold. This parameterization is indicated in FIG. 12 by $x_{\#}$ (i).

After filtering the audio values 906, quantization with a constant step size takes place, such as, for example, a rounding operation to the next integer. The quantizing noise caused by this is white noise. On the decoder side, the filtered signal is "retransformed" again by a parameterizable filter, the transfer function of which is set to the magnitude of the masking threshold itself. Not only is the filtered signal decoded again by this, but the quantizing noise on the decoder side is also adjusted to the form or shape of the masking threshold. In order for the quantizing noise to correspond to the masking threshold as precisely as possible, an amplification value $a_{\#}$ applied to the filtered signal before quantizing is calculated on the coder side for each parameter set or each parameterization. In order for the retransform to be performed on the decoder side, the amplification value a and the parameterization x are transferred to the coder as side information 910 apart from the actual main data, namely the quantized filtered audio values 912. For the redundancy reduction 914, this data, i.e. the side information 910 and the main data 912, is subjected to a loss-free compression, namely entropy coding, which is how the coded signal is obtained.

The above-mentioned article suggests a size of 128 sample values 906 as a block size. This allows a relatively short delay of 8 ms with a sampling rate of 32 kHz. With reference to the detailed implementation, the article also states that, for increasing the efficiency of the side information coding, the side information, namely the coefficients $x_{\#}$ and $a_{\#}$, will only be transferred if there are sufficient changes compared to a parameter set transferred before, i.e. if the changes exceed a certain threshold value. In addition, it is described that the implementation is preferably performed such that a current parameter set is not directly applied to all the sample values belonging to the respective block, but that a linear interpolation of the filter coefficients $x_{\#}$ is used to avoid audible artifacts. In order to perform the linear interpolation of the filter coefficients, a lattice structure is suggested for the filter to prevent instabilities from occurring. For the case that a coded signal with a controlled bit rate is desired, the article also suggests selectively multiplying or attenuating the filtered signal scaled with the time-depending amplification factor a by a factor unequal to 1 so that audible interferences occur, but the bit rate can be reduced at sites of the audio signal which are complicated to code.

Although the audio coding scheme described in the article mentioned above already reduces the delay time for many applications to a sufficient degree, a problem in the above scheme is that, due to the requirement of having to transfer the masking threshold or transfer function of the coder-side filter, subsequently referred to as pre-filter, the transfer channel is loaded to a relatively high degree even though the filter coefficients will only be transferred when a predetermined threshold is exceeded.

Another disadvantage of the above coding scheme is that, due to the fact that the masking threshold or inverse thereof has to be made available on the decoder side by the parameter set $x_{\#}$ to be transferred, a compromise has to be made between the lowest possible bit rate or high compression ratio on the one hand and the most precise approximation possible or parameterization of the masking threshold or inverse thereof on the other hand. Thus, it is inevitable for the quantizing noise adjusted to the masking threshold by the above audio coding scheme to exceed the masking threshold in some frequency ranges and thus result in audible audio interferences for the listener. FIG. 13, for example, shows the parameterized frequency response of the decoder-side parameterizable filter by graph c. As can be seen, there are regions where the transfer function of the decoder-side filter, subsequently referred to as post-filter, exceeds the masking threshold b. The problem is aggravated by the fact that the parameterization is only transferred intermittently with a sufficient change between parameterizations and interpolated therebetween. An interpolation of the filter coefficients $x_{\#}$, as is suggested in the article, alone results in audible interferences when the amplification value $a_{\#}$ is kept constant from node to node or from new parameterization to new parameterization. Even if the interpolation suggested in the article is also applied to the side information value $a_{\#}$, i.e. the amplification value transferred, audible audio artifacts may remain in the audio signal arriving on the decoder side.

Another problem with the audio coding scheme according to FIGS. 12 and 13 is that the filtered signal may, due to the frequency-selective filtering, take a non-predictable form where, particularly due to a random superposition of many individual harmonic waves, one or several individual audio values of the coded signal add up to very high values which in turn result in a poorer compression ratio in the subsequent redundancy reduction due to their rare occurrence.

SUMMARY OF THE INVENTION

It is an object of the present invention to provide an audio coding scheme allowing coding producing fewer audible artifacts.

In accordance with a first aspect, the present invention provides a device for coding an audio signal of a sequence of audio values into a coded signal, having: means for applying a psycho-acoustic model to a first block of audio values of the sequence of audio values and a second block of audio values of the sequence of audio values; means for calculating a version of a first parameterization of a parameterizable filter based on a result of applying the psycho-acoustic model to the first block and a version of a second parameterization of the parameterizable filter based on a result of applying the psycho-acoustic model to the second block; means for determining a first noise power limit based on the result of applying the psycho-acoustic model to the first block and a second noise power limit based on the result of applying the psycho-acoustic model to the second block; means for parameterizably filtering and scaling a predetermined block of audio values of the sequence of audio values to obtain a block of scaled filtered audio values corresponding to the predetermined block, having: means for interpolating between the version of the first parameterization and the version of the second parameterization to obtain a version of an interpolated parameterization for a predetermined audio value in the predetermined block of audio values; means for interpolating between the first noise power limit and the second noise power limit to obtain an interpolated noise power limit for the predetermined audio value; means for determining an intermediate scaling value depending on the interpolated noise power limit; and means for applying the parameterizable filter with the version of the interpolated parameterization and the intermediate scaling value to the predetermined audio values to obtain one of the scaled filtered audio values; means for quantizing the scaled filtered audio values according to the quantizing rule to obtain a block of quantized scaled filtered audio values; and means for integrating information into the coded signal from which the block of quantized scaled filtered audio values, the version of the first parameterization, the version of the second parameterization, the first noise power limit and the second noise power limit may be derived.

In accordance with a second aspect, the present invention provides a method for coding an audio signal of a sequence of audio values into a coded signal, having the steps of: applying a psycho-acoustic model to a first block of audio values of the sequence of audio values and a second block of audio values of the sequence of audio values; calculating a version of a first parameterization of a parameterizable filter based on a result of applying the psycho-acoustic model to the first block and a version of a second parameterization of the parameterizable filter based on a result of applying the psycho-acoustic model to the second block; determining a first noise power limit based on the result of applying the psycho-acoustic model to the first block and a second noise power limit based on the result of applying the psycho-acoustic model to the second block; parameterizably filtering and scaling a predetermined block of audio values of the sequence of audio values to obtain a block of scaled filtered audio values corresponding to the predetermined block, having the following substeps: interpolating between the version of the first parameterization and the version of the second parameterization to obtain a version of an interpolated parameterization for a predetermined audio value in the predetermined block of audio values; interpolating between the first noise power limit and the second noise power limit to obtain an interpolated noise power limit for the predetermined audio value; determining an intermediate scaling value depending on the interpolated noise power limit; and applying the parameterizable filter with the version of the interpolated parameterization and the intermediate scaling value to the predetermined audio value to obtain one of the scaled filtered audio values; quantizing the scaled filtered audio values to obtain a block of quantized scaled filtered audio values; and integrating information into the coded signal from which the block of quantized scaled filtered audio values, the version of the first parameterization, the version of the second parameterization, the first noise power limit and the second noise power limit may be derived.

In accordance with a third aspect, the present invention provides a device for decoding a coded signal into a decoded audio signal, wherein the coded signal contains information from which a predetermined block of quantized scaled filtered audio values, a version of a first parameterization, a version of a second parameterization, a first noise power limit and a second noise power limit may be derived, having: means for deriving the predetermined block of quantized scaled filtered audio values, the version of the first parameterization, the version of the second parameterization, the first noise power limit and the second noise power limit from the coded signal; means for parameterizably filtering and scaling the predetermined block of quantized scaled filtered audio values to obtain a corresponding block of decoded audio values, having: means for interpolating between the version of the first parameterization and the version of the second parameterization to obtain a version of an interpolated parameterization for a predetermined audio value in the block of quantized scaled filtered audio values; means for interpolating between the first noise power limit and the second noise power limit to obtain an interpolated noise power limit for the predetermined audio value; means for determining an intermediate scaling value depending on the interpolated noise power limit; and means for applying the parameterizable filter with the version of the interpolated parameterization and the intermediate scaling value to the predetermined audio value to obtain one of the decoded audio values.

In accordance with a fourth aspect, the present invention provides a method for decoding a coded signal into a decoded audio signal, the coded signal containing information from which a predetermined block of quantized scaled filtered audio values, a version of a first parameterization, a version of a second parameterization, a first noise power limit and a second noise power limit may be derived, having the steps of: deriving the predetermined block of quantized scaled filtered audio values, the version of the first parameterization, the version of the second parameterization, the first noise power limit and the second noise power limit from the coded signal; parameterizably filtering and scaling the predetermined block of quantized scaled filtered audio values to obtain a corresponding block of decoded audio values, having the following substeps: interpolating between the version of the first parameterization and the version of the second parameterization to obtain a version of an interpolated parameterization for a predetermined audio value in the block of quantized scaled filtered audio values; interpolating between the first noise power limit and the second noise power limit to obtain an interpolated noise power limit for the predetermined audio value; determining an intermediate scaling value depending on the interpolated noise power limit; and applying the parameterizable filter with the version of the interpolated parameterization and the intermediate scaling value to the predetermined audio value to obtain one of the decoded audio values.

In accordance with a fifth aspect, the present invention provides a computer program having a program code for performing one of the above methods, when the computer program runs on a computer.

Inventive coding of an audio signal of a sequence of audio values into a coded signal includes determining a first listening threshold for a first block of audio values of the sequence of audio values and a second listening threshold for a second block of audio values of the sequence of audio values; calculating a version of a first parameterization of a parameterizable filter so that the transfer function thereof roughly corresponds to the inverse of the magnitude of the first listening threshold and a version of a second parameterization of the parameterizable filter so that the transfer function thereof roughly corresponds to the inverse of the magnitude of the second listening threshold; determining a first noise power limit depending on the first masking threshold and a second noise power limit depending on the second masking threshold; parameterizably filtering and scaling or amplifying a predetermined block of audio values of the sequence of audio values to obtain a block of scaled filtered audio values corresponding to the predetermined block, the latter step comprising the following substeps: interpolating between the version of the first parameterization and the version of the second parameterization to obtain a version of an interpolated parameterization for a predetermined audio value in the predetermined block of audio values; interpolating between the first noise power limit and the second noise power limit to obtain an interpolated noise power limit for the predetermined audio value; determining an intermediate scaling value depending on the interpolated noise power limit; and applying the parameterizable filter with the version of the interpolated parameterization and the intermediate scaling value to the predetermined audio value to obtain one of the scaled filtered audio values. Finally, quantizing of the scaled filtered audio values takes place to obtain a block of quantized scaled filtered audio values; and integrating information into the coded signal from which the block of quantized scaled filtered audio values, the version of the first parameterization, the version of the second parameterization, the first noise power limit and the second noise power limit may be derived.

The central idea of the present invention is that the prior procedure, namely interpolation relative to the filter coefficients and the amplification value, for obtaining interpolated values for the intermediate audio values starting from the nodes has to be dismissed. Coding containing less audible artifacts can be obtained by not interpolating the amplification value, but rather taking the power limit derived from the masking threshold, preferably as the area below the square of the magnitude of the masking threshold, for each node, i.e. for each parameterization to be transferred, and then performing the interpolation between these power limits of neighboring nodes, such as, for example, a linear interpolation. On both the coder and the decoder side, an amplification value can then be calculated from the intermediate power limit determined such that the quantizing noise caused by quantization, which has a constant frequency before post-filtering on the decoder side, is below the power limit or corresponds thereto after post-filtering.

BRIEF DESCRIPTION OF THE DRAWINGS

Preferred embodiments of the present invention will be detailed subsequently referring to the appended drawings, in which.

DESCRIPTION OF PREFERRED EMBODIMENTS

Figure 1:
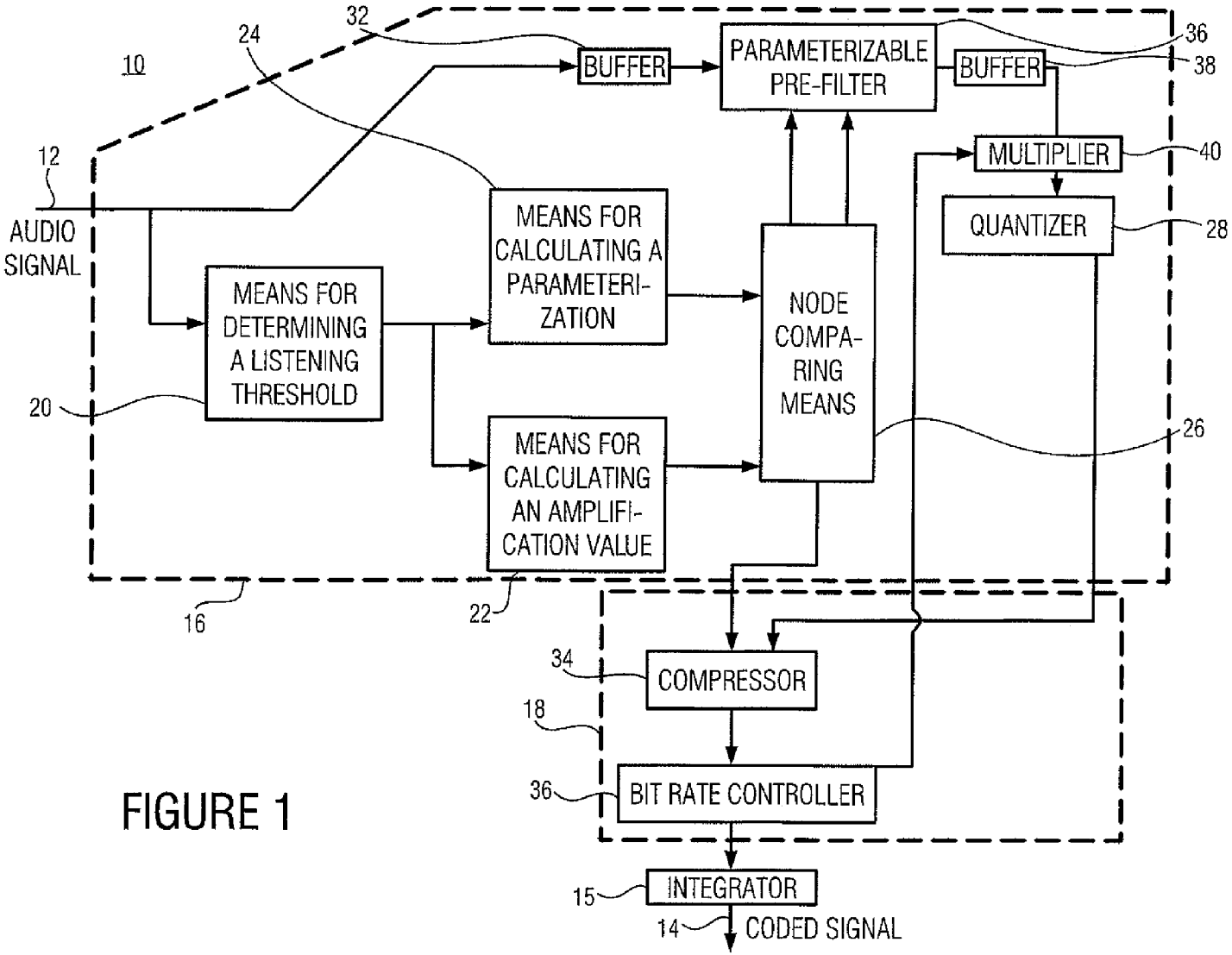
FIG. 1 shows a block circuit diagram of an audio coder according to an embodiment of the present invention.

FIG. 1 shows an audio coder according to an embodiment of the present invention. The audio coder, which is generally indicated by 10, includes a data input 12 where it receives the audio signal to be coded, which, as will be explained in greater detail later referring to FIG. 5*a*, consists of a sequence of audio values or sample values, and a data output where the coded signal is output, the information content of which will be discussed in greater detail referring to FIG. 5*b*.

The audio coder 10 of FIG. 1 is divided into an irrelevance reduction part 16 and a redundancy reduction part 18. The irrelevance reduction part 16 includes means 20 for determining a listening threshold, means 22 for calculating an amplification value, means 24 for calculating a parameterization, node comparing means 26, a quantizer 28 and a parameterizable pre-filter 30 and an input FIFO (first in first out) buffer 32, a buffer or memory 38 and a multiplier or multiplying means 40. The redundancy reduction part 18 includes a compressor 34 and a bit rate controller 36.

Figures 5A, 5B:
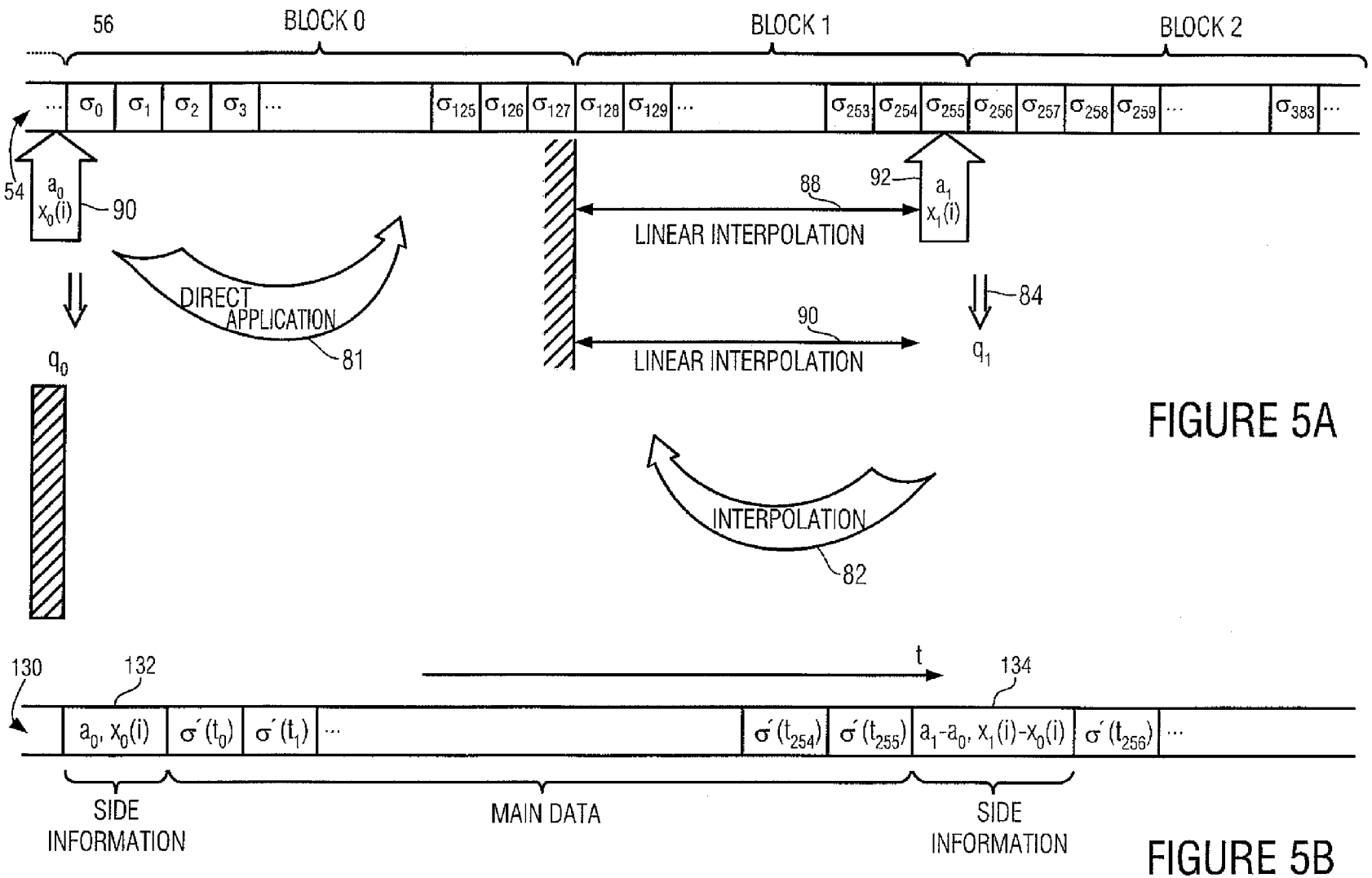
FIG. 5*a* shows a schematic diagram for illustrating the incoming audio signal, the sequence of audio values it consists of, and the operating steps of FIG. 4 in relation to the audio values.
FIG. 5*b* shows a schematic diagram for illustrating the setup of the coded signal.

The irrelevance reduction part 16 , the redundancy reduction part 18 and an integrator 15 for integrating the redundancy and irrelevancy reduced signal into a coded signal, the functionality of which is described in more detail below with respect to FIG. 5*b*, are connected in series in this order between the data input 12 and the data output 14. In particular, the data input 12 is connected to a data input of the means 20 for determining a listening threshold and to a data input of the input buffer 32. A data output of the means 20 for determining a listening threshold is connected to an input of the means 24 for calculating a parameterization and to a data input of the means 22 for calculating an amplification value to pass on a listening threshold determined to same. The means 22 and 24 calculate a parameterization or amplification value based on the listening threshold and are connected to the node comparing means 26 to pass on these results to same. Depending on the result of the comparison, the node comparing means 26, as will be discussed subsequently, passes on the results calculated by the means 22 and 24 as input parameter or parameterization to the parameterizable pre-filter 30. The parameterizable pre-filter 30 is connected between a data output of the input buffer 32 and a data input of the buffer 38. The multiplier 40 is connected between a data output of the buffer 38 and the quantizer 28. The quantizer 28 passes on filtered audio values which may be multiplied or scaled, but always quantized, to the redundancy reduction part 18, more precisely to a data input of the compressor 34. The node comparing means 26 passes on information from which the input parameters passed to the parameterizable pre-filter 30 may be derived to the redundancy reduction part 18, more precisely to another data input of the compressor 34. The bit rate controller is connected to a control input of the multiplier 40 via a control connection to provide for the quantized filtered audio values, as received from the pre-filter 30, to be multiplied by the multiplier 40 by a suitable multiplicand, as will be discussed in greater detail below. The bit rate controller 36 is connected between a data output of the compressor 34 and the data output 14 of the audio coder 10 in order to determine the multiplicand for the multiplier 40 in a suitable manner. When each audio value passes the quantizer 40 for the first time, the multiplicand is at first set to a suitable scaling factor, such as, for example, 1. The buffer 38, however, continues storing each filtered audio value to give the bit rate controller 36, as will be described subsequently, a possibility of changing the multiplicand for another pass of a block of audio values. If such a change is not indicated by the bit rate controller 36, the buffer 38 may release the memory taken up by this block.

After the setup of the audio coder of FIG. 1 has been described above, the mode of functioning thereof will subsequently be described referring to FIGS. 2 to 7*b*.

Figure 2:
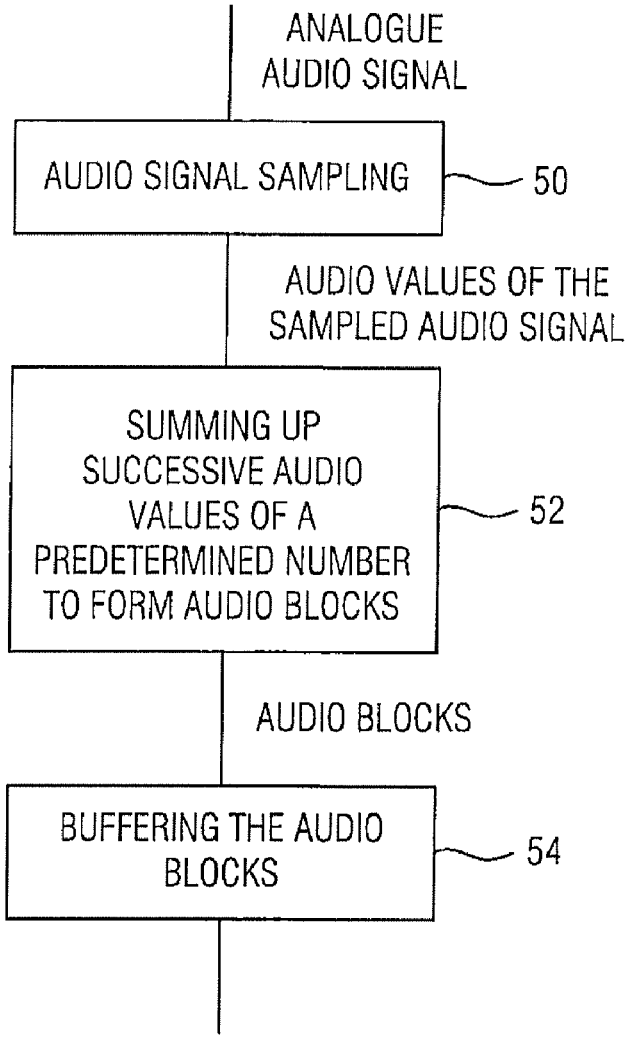
FIG. 2 shows a flow chart for illustrating the mode of functioning of the audio coder of FIG. 1 at the data input.

As can be seen from FIG. 2, the audio signal, when having reached the audio input 12, has already been obtained by audio signal sampling 50 from an analog audio signal. The audio signal sampling is performed with a predetermined sampling frequency, which is usually between 32 and 48 kHz. Consequently, at the data input 12 there is an audio signal consisting of a sequence of sample or audio values. Although the coding of the audio signal does not take place in a block-based manner, as will become obvious from the subsequent description, the audio values at the data input 12 are at first combined to form audio blocks in step 52. The combination to form audio blocks takes place only for the purpose of determining the listening threshold, as will become obvious from the following description, and takes place in an input stage of the means 20 for determining a listening threshold. In the present embodiment, it is exemplarily assumed that 128 successive audio values each are combined to form audio blocks and that the combination takes place such that, one the one hand, successive audio blocks do not overlap and, on the other hand, are direct neighbors of one another. This will exemplarily be discussed shortly referring to FIG. 5*a*.

FIG. 5*a* at 54 indicates the sequence of sample values, each sample value being illustrated by a rectangle 56. The sample values are numbered for illustration purposes, wherein for reasons of clarity in turn only some sample values of the sequence 54 are shown. As is indicated by braces above the sequence 54, 128 successive sample values each are combined to form a block according to the present embodiment, wherein the directly successive 128 sample values form the next block. Only as a precautionary measure, it is to be pointed out that the combination to form blocks could also be performed differently, exemplarily by overlapping blocks or spaced-apart blocks and blocks having another block size, although the block size of 128 in turn is preferred since it provides a good tradeoff between high audio quality on the one hand and the smallest possible delay time on the other hand.

Whereas the audio blocks combined in the means 20 in step 52 are processed in the means 20 for determining a listening threshold block by block, the incoming audio values will be buffered 54 in the input buffer 32 until the parameterizable pre-filter 30 has obtained input parameters from the node comparing means 26 to perform pre-filtering, as will be described subsequently.

Figure 3:
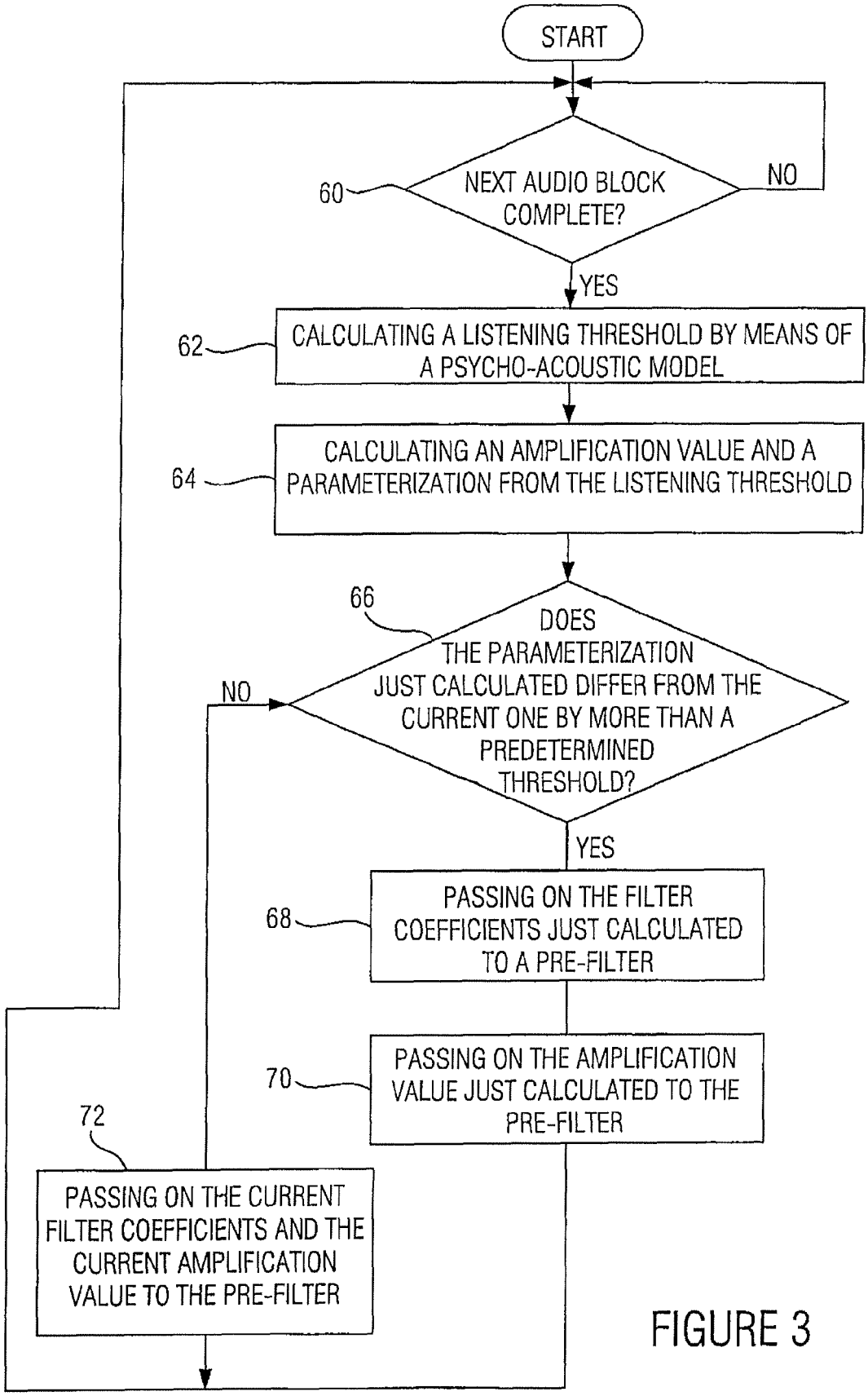
FIG. 3 shows a flow chart for illustrating the mode of functioning of the audio coder of FIG. 1 with regard to the evaluation of the incoming audio signal by a psycho-acoustic model.
Figure 12:
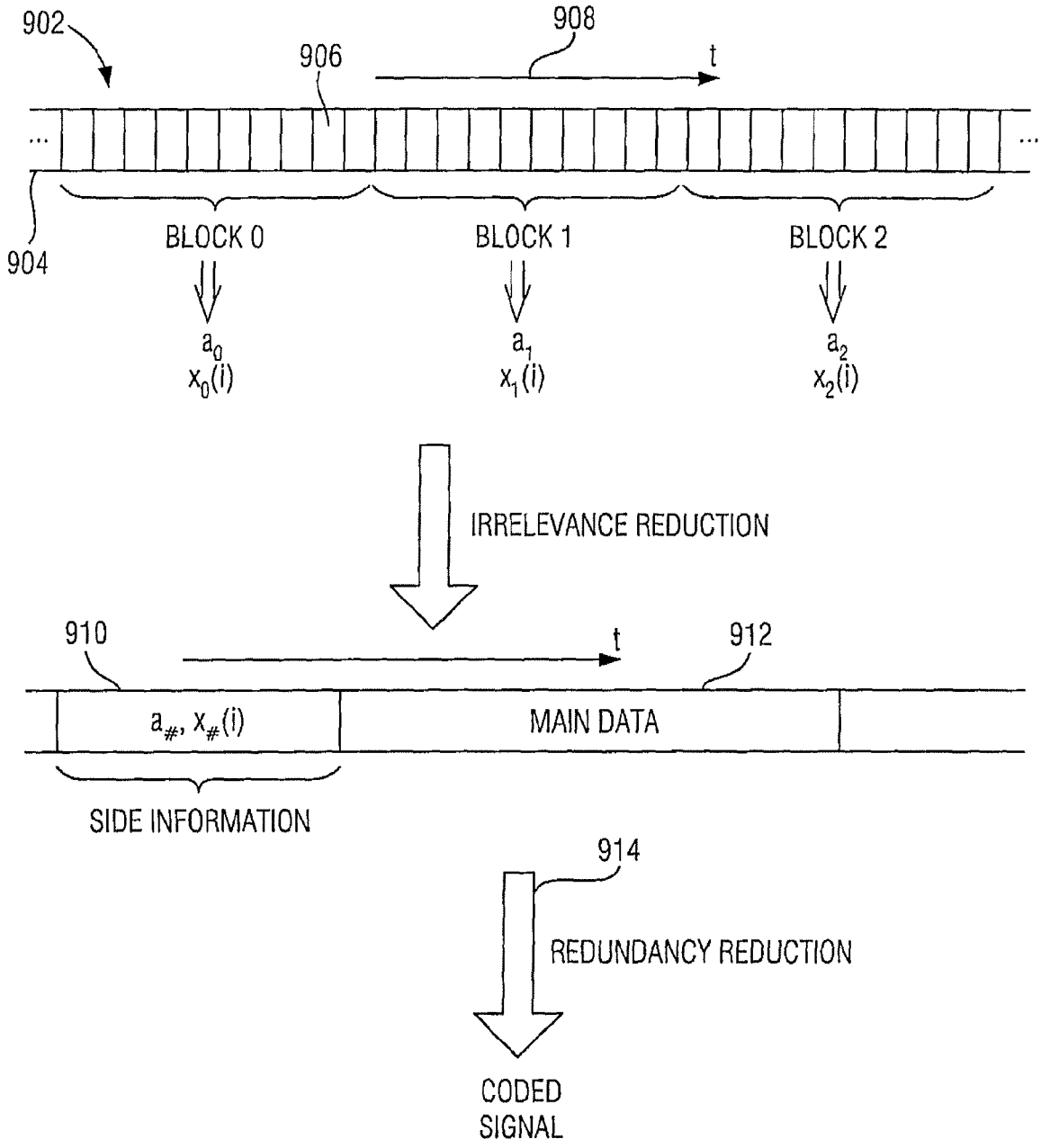
FIGURE 12 (PRIOR ART)
FIG. 12 shows a schematic diagram for illustrating a conventional audio coding scheme having a short delay time.
Figure 13:
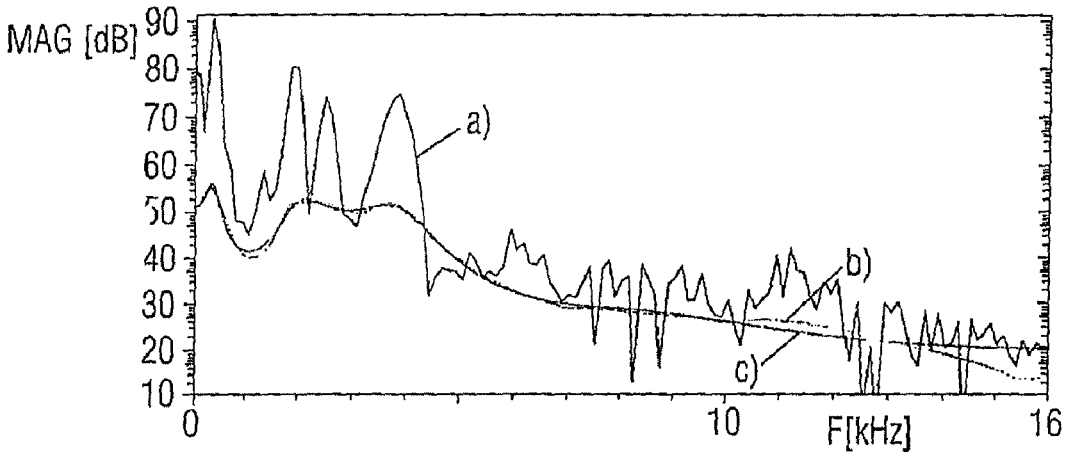
FIGURE 13 (PRIOR ART)
FIG. 13 shows a diagram where, exemplarily, a spectrum of an audio signal, a listening threshold thereof and the transfer function of the post-filter in the decoder are shown.

As can be seen from FIG. 3, the means 20 for determining a listening threshold starts its processing directly after sufficient audio values have been received at the data input 12 to form an audio block or to form the next audio block, which the means 20 monitors by an inspection in step 60. If there is no complete processable audio block, the means 20 will wait. If a complete audio block to be processed is present, the means 20 for determining a listening threshold will calculate a listening threshold in step 62 on the basis of a suitable psycho-acoustic model in step 62. For illustrating the listening threshold, reference is again made to FIG. 12 and, in particular, to graph b having been obtained on the basis of a psycho-acoustic model, exemplarily with regard to a current audio block with a spectrum a. The masking threshold which is determined in step 62 is a frequency-dependent function which may vary for successive audio blocks and may also vary considerably from audio signal to audio signal, such as, for example, from rock music to classical music pieces. The listening threshold indicates for each frequency a threshold value below which the human hearing cannot perceive interferences.

In a subsequent step 64, the means 24 and the means 22 calculate from the listening threshold M(f) calculated (f indicating the frequency) an amplification value a or parameter set of filter coefficients $a_k$. The parameterization x(i) which the means 24 calculates in step 64 is provided for the parameterizable pre-filter 30 which is, for example, embodied in an adaptive filter structure, as is used in LPC coding (LPC=linear predictive coding). For example, s(n), n=0, . . . , 127, be the 128 audio values of the current audio block and s'(n) be the resulting filtered 128 audio values, then the filter is exemplarily embodied such that the following equation applies:

$$s'(n) = s(n) - \sum_{k=1}^{K} a_k^t s(n-k),$$

K being the filter order and $a_k^t$, k=1, . . . , K, being the filter coefficients, and the index t is to illustrate that the filter coefficients change in successive audio blocks. The means 24 then calculates the parameterization $a_k^t$ such that the transfer function H(f) of the parameterizable pre-filter 30 roughly equals the inverse of the magnitude of the masking threshold M(f), i.e. such that the following applies:

$$H(f, t) \approx \frac{1}{|M(f, t)|}$$

wherein the dependence of t in turn is to illustrate that the masking threshold M(f) changes for different audio blocks. When implementing the pre-filter 30 as the adaptive filter mentioned above, the filter coefficients $a_k^t$ will be obtained as follows: the inverse discrete Fourier transform of $|M(f,t)|^2$ over the frequency for the block at the time t results in the target auto-correlation function $r_{mm}^t(i)$. Then, the $a_k^t$ are obtained by solving the linear equation system:

$$\sum_{k=0}^{K-1} r_{mm}^t(|k-i|)a_k^t = r_{mm}^t(i+1), \quad 0 \le i < K.$$

In order for no instabilities to arise between the parameterizations in the linear interpolation described in greater detail below, a lattice structure is preferably used for the filter 30, wherein the filter coefficients for the lattice structure are re-parameterized to form reflection coefficients. With regard to further details as to the design of the pre-filter, the calculation of the coefficients and the re-parameterization, reference is made to the article by Schuller etc. mentioned in the introduction to the description and, in particular, to page 381, division III, which is incorporated herein by reference.

Whereas consequently the means 24 calculates a parameterization for the parameterizable pre-filter 30 such that the transfer function thereof equals the inverse of the masking threshold, the means 22 calculates a noise power limit based on the listening threshold, namely a limit indicating which noise power the quantizer 28 is allowed to introduce into the audio signal filtered by the pre-filter 30 in order for the quantizing noise on the decoder side to be below the listening threshold M(f) or exactly equal it after post-or reverse-filtering. The means 22 calculates this noise power limit as the area below the square of the magnitude of the listening threshold M, i.e. as $\Sigma|M(f)|^2$. This means 22 calculates the amplification value a from the noise power limit by calculating the root of the fraction of the quantizing noise power divided by the noise power limit. The quantizing noise is the noise caused by the quantizer 28. The noise caused by the quantizer 28 is, as will be described below, white noise and thus frequency-independent. The quantizing noise power is the power of the quantizing noise.

As has become evident from the above description, the means 22 also calculates the noise power limit apart from the amplification value a. Although it is possible for the node comparing means 26 to again calculate the noise power limit from the amplification value a obtained from the means 22, it is also possible for the means 22 to also transmit the noise power limit determined to the node comparing means 26 apart from the amplification value a.

After calculating the amplification value and the parameterization, the node comparing means 26 checks in step 66 whether the parameterization just calculated differs by more than a predetermined threshold from the current last parameterization passed on to the parameterizable pre-filter. If the check in step 66 has the result that the parameterization just calculated differs from the current one by more than the predetermined threshold, the filter coefficients just calculated and the amplification value just calculated or noise power limit are buffered in the node comparing means 26 for an interpolation to be discussed and the node comparing means 26 hands over to the pre-filter 30 the filter coefficients just calculated in step 68 and the amplification value just calculated in step 70. If, however, this is not the case and the parameterization just calculated does not differ from the current one by more than the predetermined threshold, the node comparing means (26) will hand over to the pre-filter 30 in step 72, instead of the parameterization just calculated, only the current node parameterization, i.e. that parameterization which last resulted in a positive result in step 66, i.e. differed from a previous node parameterization by more than a predetermined threshold. After steps 70 and 72, the process of FIG. 3 returns to processing the next audio block, i.e. to a query 60.

In the case that the parameterization just calculated does not differ from the current node parameterization and consequently the pre-filter 30 in step 72 again obtains the node parameterization already obtained for at least the last audio block, the pre-filter 30 will apply this node parameterization to all the sample values of this audio block in the FIFO 32, as will be described in greater detail below, which is how this current block is taken out of the FIFO 32 and the quantizer 28 receives a resulting audio block of pre-filtered audio values.

Figure 4:
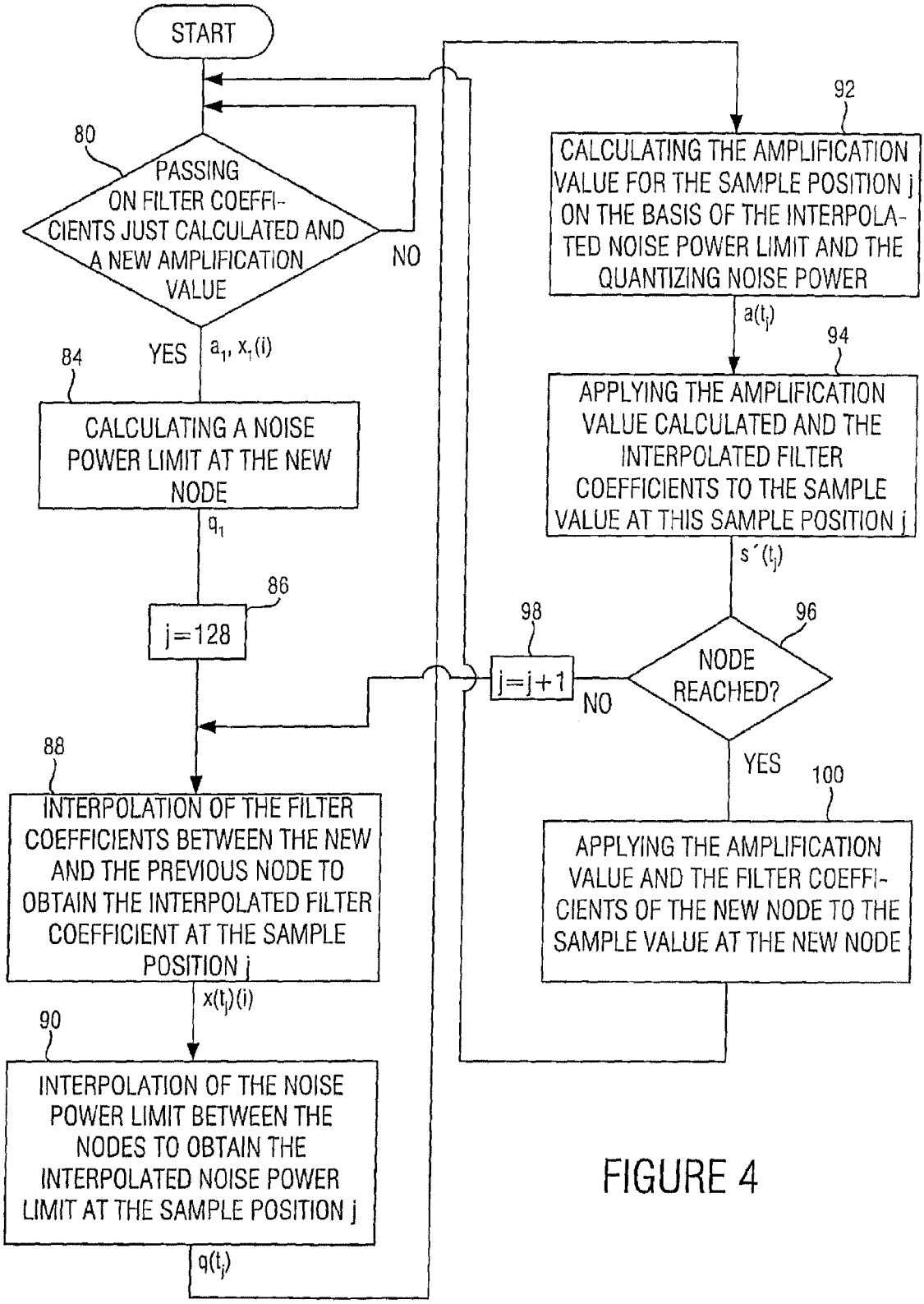
FIG. 4 shows a flow chart for illustrating the mode of functioning of the audio coder of FIG. 1 with regard to applying the parameters obtained by the psycho-acoustic model to the incoming audio signal.

FIG. 4 illustrates the mode of functioning of the parameterizable pre-filter 30 for the case it receives the parameterization just calculated and the amplification value just calculated, because they differ sufficiently from the current node parameterization in greater detail. As has been described referring to FIG. 3, there is no processing according to FIG. 4 for each of the successive audio blocks, but only for audio blocks where the respective parameterization differed sufficiently from the current node parameterization. The other audio blocks are, as has just been described, pre-filtered by applying the respective current node parameterization and the pertaining respective current amplification value to all the sample values of these audio blocks.

In step 80, the parameterizable pre-filter 30 checks whether a handover of filter coefficients just calculated from the node comparing means 26 has taken place, or of older node parameterizations. The pre-filter 30 performs the check 80 until such a handover has taken place.

As soon as such a handover has taken place, the parameterizable pre-filter 30 starts processing the current audio block of audio values just in the buffer 32, i.e. that one for which the parameterization has just been calculated. In FIG. 5*a*, it is for example illustrated that all the audio values 56 in front of the audio value with number 0 have already been processed and have thus already passed the memory 32. The processing of the block of audio values in front of the audio value with number 0 was triggered because the parameterization calculated for the audio block in front of block 0, namely $x_0(i)$, differed from the node parameterization passed on before to the pre-filter 30 by more than the predetermined threshold. The parameterization $x_0(i)$ thus is a node parameterization as is described in the present invention. The processing of the audio values in the audio block in front of the audio value 0 was performed on the basis of the parameter set $a_0$, $x_0(i)$.

It is assumed in FIG. 5*a* that the parameterization having been calculated for block 0 with the audio values 0-127 differed by less than the predetermined threshold from the parameterization $x_0(i)$ which referred to the block in front. This block 0 was thus also taken out of the FIFO 32 by the pre-filter 30, equally processed with regard to all its sample values 0-127 by means of the parameterization $x_0(i)$ supplied in step 72, as is indicated by the arrow 81 described by "direct application", and then passed on to the quantizer 28.

The parameterization calculated for block 1 still located in the FIFO 32, however, in contrast differed, according to the illustrative example of FIG. 5*a*, by more than the predetermined threshold from the parameterization $x_0(i)$ and was thus passed on in step 68 to the pre-filter 30 as a parameterization $x_1(i)$, together with the amplification value $a_1$ (step 70) and, if applicable, the pertaining noise power limit, wherein the indices of a and x in FIG. 5*a* are to be an index for the nodes, as are used in the interpolation to be discussed below, which is performed with regard to the sample values 128-255 in block 1, symbolized by an arrow 82 and realized by the steps following step 80 in FIG. 4. The processing at step 80 would thus start with the occurrence of the audio block with number 1.

At the time when the parameter set $a_1$, $x_1$ is passed on, only the audio values 128-255, i.e. the current audio block after the last audio block 0 processed by the pre-filter 30, are in the memory 32. After determining the handover of node parameters $x_1(i)$ in step 80, the pre-filter 30 determines the noise power limit $q_1$ corresponding to the amplification value $a_1$ in step 84. This may take place by the node comparing means 26 passing on this value to the pre-filter 30 or by the pre-filter 30 again calculating this value, as has been described above referring to step 64.

After that, an index j is initialized to a sample value in step 86 to point to the oldest sample value remaining in the FIFO memory 32 or the first sample value of the current audio block "block 1", i.e. in the present example of FIG. 5*a* the sample value 128. In step 88, the parameterizable pre-filter performs an interpolation between the filter coefficients $x_0$ and $x_1$, wherein here the parameterization $x_0$ acts as a node at the node having the audio value number 127 of the previous block 0 and the parameterization $x_1$ acts as a node at the node having the audio value number 255 of the current block 1. These audio value positions 127 and 255 will subsequently be referred to as node 0 and node 1, wherein the node parameterizations referring to the nodes in FIG. 5*a* are indicated by the arrows 90 and 92.

In step 88, the parameterizable pre-filter 30 performs the interpolation of the filter coefficients $x_0$, $x_1$ between the two nodes in the form of a linear interpolation to obtain the interpolated filter coefficients at the sample position j, i.e. $x(t_j)(I)$, $t<1 \ldots N$.

After that, namely in step 90, the parameterizable pre-filter 30 performs an interpolation between the noise power limit $q_1$ and $q_0$ to obtain an interpolated noise power limit at the sample position j, i.e. $q(t_j)$.

In step 92, the parameterizable pre-filter 30 subsequently calculates the amplification value for the sample position j on the basis of the interpolated noise power limit and the quantizing noise power, and preferably also the interpolated filter coefficients, namely for example depending on the root of $$\frac{\text{quantizing noise power}}{q(t_j)},$$

wherein for this reference is made to the explanations of step 64 of FIG. 3.

In step 94, the parameterizable pre-filter 30 then applies the amplification value calculated and the interpolated filter coefficients to the sample value at the sample position j to obtain a filtered sample value for this sample position, namely $s'(t_3)$.

In step 96, the parameterizable pre-filter 30 then checks whether the sample position j has reached the current node, i.e. node 1, in the case of FIG. 5*a* the sample position 255, i.e. the sample value for which the parameterization transferred to the parameterizable pre-filter 30 plus amplification value is to be valid directly, i.e. without interpolation. If this is not the case, the parameterizable pre-filter 30 will increase or increment the index j by 1, wherein steps 88-96 will be repeated. If the check in step 96, however, is positive, the parameterizable pre-filter will apply, in step 100, the last amplification value transmitted from the node comparing means 26 and the last filter coefficients transmitted from the node comparing means 26 directly without an interpolation to the sample value at the new node, whereupon the current block, i.e. in the present case block 1, has been processed, and the process is performed again at step 80 relative to the subsequent block to be processed which, depending on whether the parameterization of the next audio block block 2 differs sufficiently from the parameterization $x_1(i)$, may be this next audio block block 2 or else a later audio block.

Before the further procedure when processing the filtered sample values s' will be described referring to FIG. 5*a* and *b*, the purpose and background of the procedure of FIGS. 3 and 4 will be described below. The purpose of filtering is filtering the audio signal at the input 12 with an adaptive filter, the transfer function of which is continually adjusted to the inverse of the listening threshold to the best degree possible, which also changes over time. The reason for this is that, on the decoder side, the reverse-filtering the transfer function of which is correspondingly continuously adjusted to the listening threshold shapes the white quantizing noise introduced by quantizing the filtered audio signal, i.e. the frequency-constant quantizing noise, by an adaptive filter, namely adjusts same to the form of the listening threshold.

The application of the amplification value in steps 94 and 100 in the pre-filter 30 is a multiplication of the audio signal or the filtered audio signal, i.e. the sample values s or the filtered sample values s', by the amplification factor. The purpose is to set by this the quantizing noise introduced into the filtered audio signal by the quantization described in greater detail below, and which is adjusted by the reverse-filtering on the decoder side to the form of the listening threshold, as high as possible without exceeding the listening threshold. This can be exemplified by Parsevals formula according to which the square of the magnitude of a function equals the square of the magnitude of the Fourier transform. When on the decoder side the multiplication of the audio signal in the pre-filter by the amplification value is reversed again by dividing the filtered audio signal by the amplification value, the quantizing noise power is also reduced, namely by the factor $a^{-2}$, a being the amplification value. Consequently, the quantizing noise power can be set to an optimally high degree by applying the amplification value in the pre-filter 30, which is synonymous to the quantizing step size being increased and thus the number of quantizing steps to be coded being reduced, which in turn increases the compression in the subsequent redundancy reduction part.

Put differently, the effect of the pre-filter could be considered as a normalization of the signal to its masking threshold, so that the level of the quantizing interferences or quantizing noise can be kept constant in both time and frequency. Since the audio signal is in the time domain, the quantization may thus be performed step by step with a uniform constant quantization, as will be described subsequently. In this way, ideally any possible irrelevance is removed from the audio signal and a lossless compression scheme may be used to also remove the remaining redundancy in the pre-filtered and quantized audio signal, as will be described below.

Referring to FIG. 5*a*, it is again to be pointed out explicitly that of course the filter coefficients and amplification values $a_0$, $a_1$, $x_1$ used must be available on the decoder side as side information, that the transfer complexity of this, however, is decreased by not simply using new filter coefficients and new amplification values for each block. Rather, a threshold value check 66 takes place to only transfer the parameterizations as side information with a sufficient parameterization change and to otherwise not transfer the side information or parameterizations. An interpolation from the old to the new parameterization takes place at the audio blocks for which the parameterizations have been transferred. The interpolation of the filter coefficients takes place in the manner described above referring to step 88. The interpolation with regard to the amplification takes place by a detour, namely via a linear interpolation 90 of the noise power limit $q_0$, $q_1$. Compared to a direct interpolation via the amplification value, the linear interpolation results in a better listening result or fewer audible artifacts with regard to the noise power limit.

Figure 6:
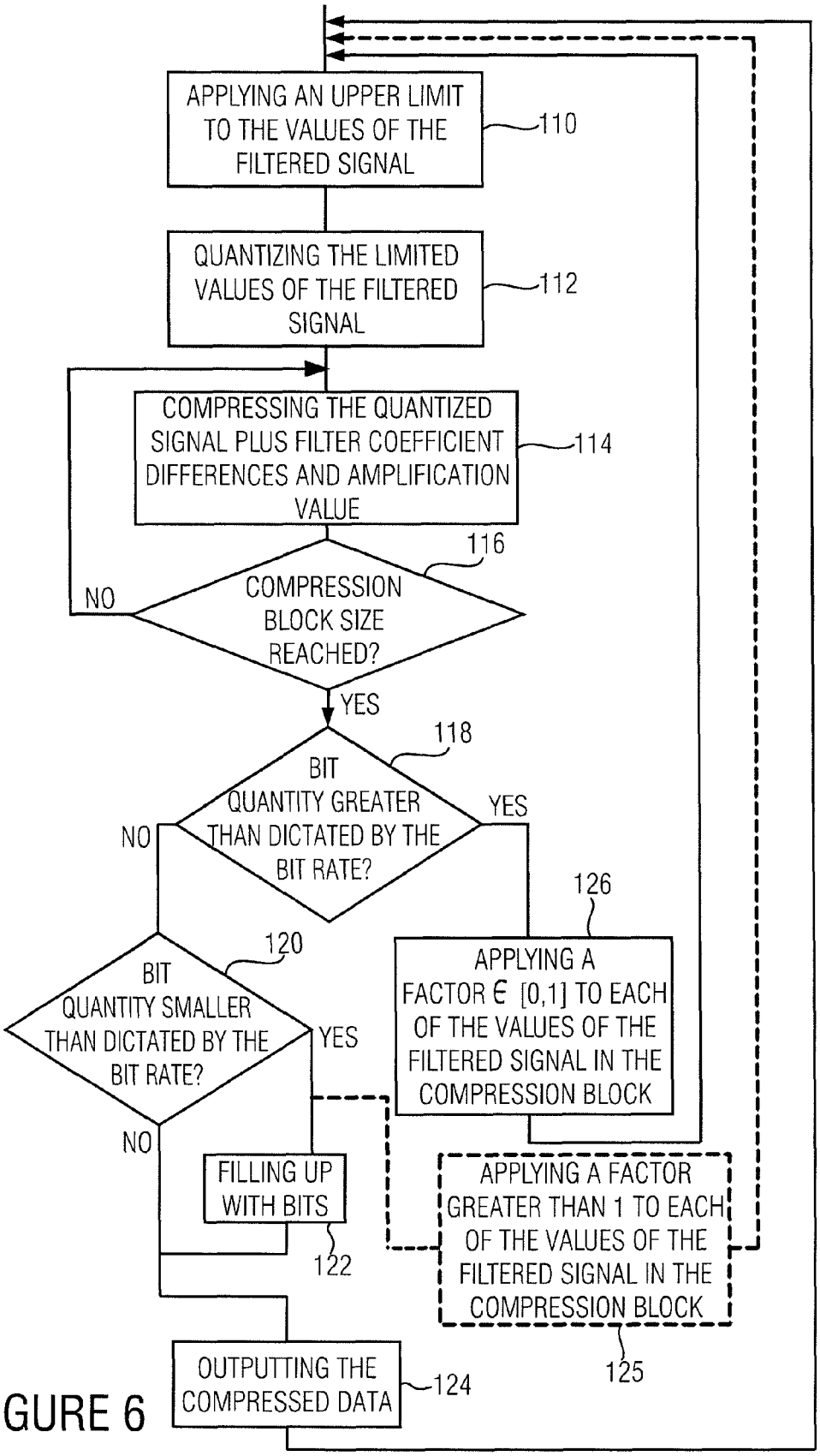
FIG. 6 shows a flow chart for illustrating the mode of functioning of the audio coder of FIG. 1 with regard to the final processing up to the coded signal.

Subsequently, the further processing of the pre-filtered signal will be described referring to FIG. 6, which basically includes quantization and redundancy reduction. First, the filtered sample values output by the parameterizable pre-filter 30 are stored in the buffer 38 and at the same time let pass from the buffer 38 to the multiplier 40 where there are, since it is their first pass, at first passed on unchanged, namely with a scaling factor of one, by the multiplier 40 to the quantizer 28. There, the filtered audio values above an upper limit are cut in step 110 and then quantized in step 112. The two steps 110 and 112 are executed by the quantizer 28. In particular, the two steps 110 and 112 are preferably executed by the quantizer 28 in one step by quantizing the filtered audio values s' by a quantizing step function which maps the filtered sample values s' exemplarily present in a floating point illustration to a plurality of integer quantizing step values or indices and which has a flat course for the filtered sample values from a certain threshold value on so that filtered sample values greater than the threshold value are quantized to one and the same quantizing step. An example of such a quantizing step function is illustrated in FIG. 7*a*.

Figure 7B:
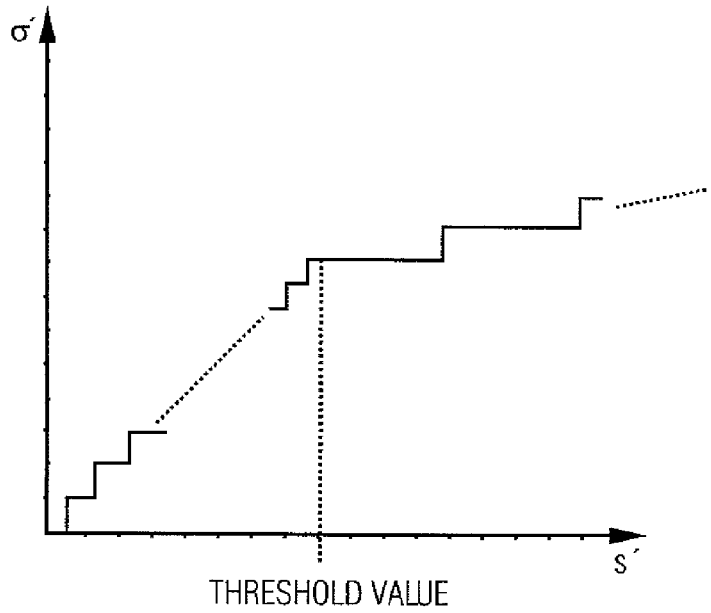
FIG. 7*b* shows a diagram where another embodiment of a quantizing step function is shown.
Figure 7A:
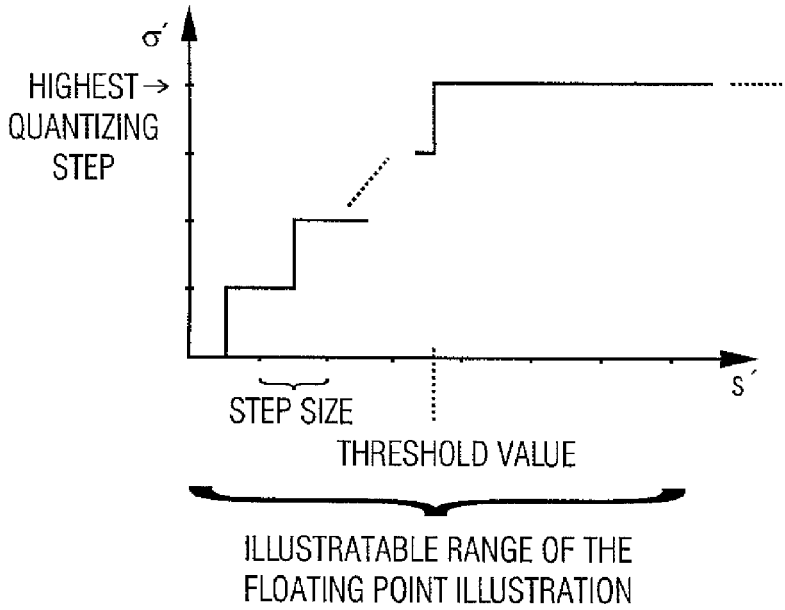
FIG. 7*a* shows a diagram where an embodiment of a quantizing step function is shown.

The quantized filtered sample values are referred to by σ' in FIG. 7*a*. The quantizing step function preferably is a quantizing step function with a step size which is constant below the threshold value, i.e. the jump to the next quantizing step will always take place after a constant interval along the input values S'. In the implementation, the step size to the threshold value is adjusted such that the number of quantizing steps preferably corresponds to a power of 2. Compared to the floating point illustration of the incoming filtered sample values s', the threshold value is smaller so that a maximum value of the illustratable region of the floating point illustration exceeds the threshold value.

The reason for this threshold value is that it has been observed that the filtered audio signal output by the pre-filter 30 occasionally comprises audio values adding up to very large values due to an unfavorable accumulation of harmonic waves. Furthermore, it has been observed that cutting these values, as is achieved by the quantizing step function shown in FIG. 7*a*, results in a high data reduction, but only in a minor impairment of the audio quality. Rather, these occasional locations in the filtered audio signal are formed artificially by a frequency-selective filtering in the parameterizable filter 30 so that cutting them impairs audio quality only to a minor extent.

A somewhat more specific example of the quantizing step function shown in FIG. 7*a* would be one which rounds all the filtered sample values s' to the next integer up to the threshold value, wherein all filtered sample values that would lead to an integer value higher than the threshold value would be quantized to the threshold value, i.e. the highest quantizing step, such as, for example, 256. This case is illustrated in FIG. 7*a*.

Another example of a possible quantizing step function would be the one shown in FIG. 7*b*. Up to the threshold value, the quantizing step function of FIG. 7*b* corresponds to that of FIG. 7*a*. Instead of having an abruptly flat course for sample values s' above the threshold value, however, the quantizing step function continues with a steepness smaller than the steepness in the region below the threshold value. Put differently, the quantizing step size is greater above the threshold value. By this, a similar effect is achieved like by the quantizing function of FIG. 7*a*, but, on the one hand, with more complexity due to the different step sizes of the quantizing step function above and below the threshold value and, on the other hand, improved audio quality, since very high filtered audio values s' are not cut off completely but only quantized with greater a quantizing step size.

As has already been described before, on the decoder side not only the quantized and filtered audio values σ' must be available, but also the input parameters for the pre-filter 30 being the basis of filtering these values, namely the node parameterization including a hint to the pertaining amplification value. In step 114, the compressor 34 thus performs a first compression trial and thus compresses side information containing the amplification values $a_0$ and $a_1$ at the nodes, such as, for example, 127 and 255, and the filter coefficients $x_0$ and $x_1$ at the nodes and the quantized filtered sample values σ' to a temporally filtered signal. The compressor 34 thus is a losslessly operating coder, such as, for example, a Huffman or arithmetic coder with or without prediction and/or adaptation.

The memory 38 which the sampled audio values σ' pass through serves as a buffer for a suitable block size with which the compressor 34 processes the quantized, filtered and also scaled, as will be described before, audio values σ' output by the quantizer 28. The block size may differ from the block size of the audio blocks as are used by the means 20.

As has already been mentioned, the bit rate controller 36 has controlled the multiplexer 40 by a multiplicand of 1 for the first compression trial so that the filtered audio values go unchanged from the pre-filter 30 to the quantizer 28 and from there as quantized filtered audio values to the compressor 34. The compressor 34 monitors in step 116 whether a certain compression block size, i.e. a certain number of quantized sampled audio values, has been coded into the temporary coded signal, or whether further quantized filtered audio values σ' are to be coded into the current temporary coded signal. If the compression block size has not been reached, the compressor 34 will continue performing the current compression 114. If the compression block size, however, has been reached, the bit rate controller 36 will check in step 118 whether the bit quantity required for the compression is greater than a bit quantity dictated by a desired bit rate. If this is not the case, the bit rate controller 36 will check in step 120 whether the bit quantity required is smaller than the bit quantity dictated by the desired bit rate. If this is the case, the bit rate controller 36 will fill up the coded signal in step 122 with filler bits until the bit quantity dictated by the desired bit rate has been reached. Subsequently, the coded signal is output in step 124. As an alternative to step 122, the bit rate controller 36 could pass on the compression block of filtered audio values σ' still stored in the memory 38 on which the last compression has been based in a form multiplied by a multiplicand greater than 1 by the multiplier 40 to the quantizer 28 for again passing steps 110-118, until the bit quantity dictated by the desired bit rate has been reached, as is indicated by a step 125 illustrated in broken lines.

If, however, the check in step 118 results in that the required bit quantity is greater than the one dictated by the desired bit rate, the bit rate controller 36 will change the multiplicand for the multiplier 40 to a factor between 0 and 1 exclusive. This is performed in step 126. After step 126, the bit rate controller 36 provides for the memory 38 to again output the last compression block of filtered audio values σ' on which the compression has been based, wherein they are subsequently multiplied by the factor set in step 126 and again supplied to the quantizer 28, whereupon steps 110-118 are performed again and the up to then temporarily coded signal is disposed of.

It is to be pointed out that when performing steps 110-116 again, in step 114 of course the factor used in step 126 (or step 125) is also integrated into the coded signal.

The purpose of the procedure after step 126 is increasing the effective step size of the quantizer 28 by the factor. This means that the resulting quantizing noise is uniformly above the masking threshold, which results in audible interferences or audible noise, but results in a reduced bit rate. If, after passing steps 110-116 again, it is again determined in step 118 that the required bit quantity is greater than the one dictated by the desired bit rate, the factor will be reduced again in step 126, etc.

If the data is finally output at step 124 as a coded signal, the next compression block will be performed from the subsequent quantized filtered audio values σ'.

It is also to be pointed out that another pre-initialized value than 1 could be used as the multiplication factor, namely, for example, 1. Then, scaling would take place in any case at first, i.e. at the very top of FIG. 6.

FIG. 5*b* illustrates again the resulting coded signal which is generally indicated by 130, and inherently, the functionality of integrator 15 of FIG. 1 which, in turn, integrates the information outlined hereinafter into the coded signal. The coded signal includes side information and main data therebetween. The side information includes, as has already been mentioned, information from which for special audio blocks, namely audio blocks where a significant change in the filter coefficients has resulted in the sequence of audio blocks, the value of the amplification value and the value of the filter coefficients can be derived. If necessary, the side information will include further information relating to the amplification value used for the bit controller. Due to the mutual dependence of the amplification value and the noise power limit q, the side information may optionally, apart from the amplification value $a_{\#}$ to a node #, also include the noise power limit $q_{\#}$, or only the latter. The side information is preferably arranged within the coded signal such that the side information to filter coefficients and pertaining amplification value or pertaining noise power limit is arranged in front of the main data to the audio block of quantized filtered audio values σ', from which these filter coefficients with pertaining amplification values or pertaining noise power limit have been derived, i.e. the side information $a_0$, $x_0(i)$ after block −1 and the side information $a_1$, $x_1(i)$ after block 1. Put differently, the main data, i.e. the quantized filtered audio values σ', starting from, excluding, an audio block of the kind where a significant change in the sequence of audio blocks has resulted in the filter coefficients, up to, including, the next audio block of this kind, in FIG. 5*a* , for example, the audio values $\sigma'(t_0)$-$t_0$ $\sigma'(t_{255})$, will always be arranged between the side information block 132 to the first one of these two audio blocks (block −1) and the other side information block 134 to the second one of the two audio blocks (block 1). The audio values $\sigma'(t_0)$-$\sigma'(t_{127})$ are decodable or have been, as has been mentioned before referring to FIG. 5*a*, obtained only by means of the side information 132, whereas the audio values $\sigma'(t_{128})$-$t_0$ $\sigma'(t_{255})$ have been obtained by interpolation by means of the side information 132 as support values at the node with the sample value number 127 and by means of the side information 134 as support values at the node with the sample value number 255 and are thus decodable only by meansm of both side information.

In addition, the side information regarding the amplification value or the noise power limit and the filter coefficients in each side information block 132 and 134 are not always integrated independently of each other. Rather, this side information is transferred in differences to the previous side information block. In FIG. 5*b* for example, the side information block 132 contains the amplification value $a_0$ and filter coefficients $x_0$ with regard to the node at the time $t_{-1}$. In the side information block 132, these values may be derived from the block itself. From the side information block 134, however, the side information regarding the node at the time $t_{255}$ may no longer be derived from this block alone. Rather, the side information block 134 only includes information on differences of the amplification value $a_1$ of the node at the time $t_{255}$ and the amplification value of the node at the time to and the differences of the filter coefficients $x_1$ and the filter coefficients $x_0$. The side information block 134 consequently only contains the information on $a_1$-$a_0$ and $x_1(i)$-$x_0(i)$. At intermitting times, however, the filter coefficients and the amplification value or the noise power limit should be transferred completely and not only as a difference to the previous node, such as, for example, each second to allow a receiver or decoder latching into a running stream of coding data, as will be discussed below.

This kind of integrating the side information into the side information blocks 132 and 134 offers the advantage of the possibility of a higher compression rate. The reason for this is that, although the side information will, if possible, only be transferred if a sufficient change of the filter coefficients to the filter coefficients of a previous node has resulted, the complexity of calculating the difference on the coder side or calculating the sum on the decoder side pays off since the resulting differences are small in spite of the query of step 66 to thus allow advantages in entropy coding.

After an embodiment of an audio coder has been described before, an embodiment of an audio decoder which is suitable for decoding the coded signal generated by the audio coder 10 of FIG. 1 to a decoded playable or processable audio signal will be described subsequently.

Figure 8:
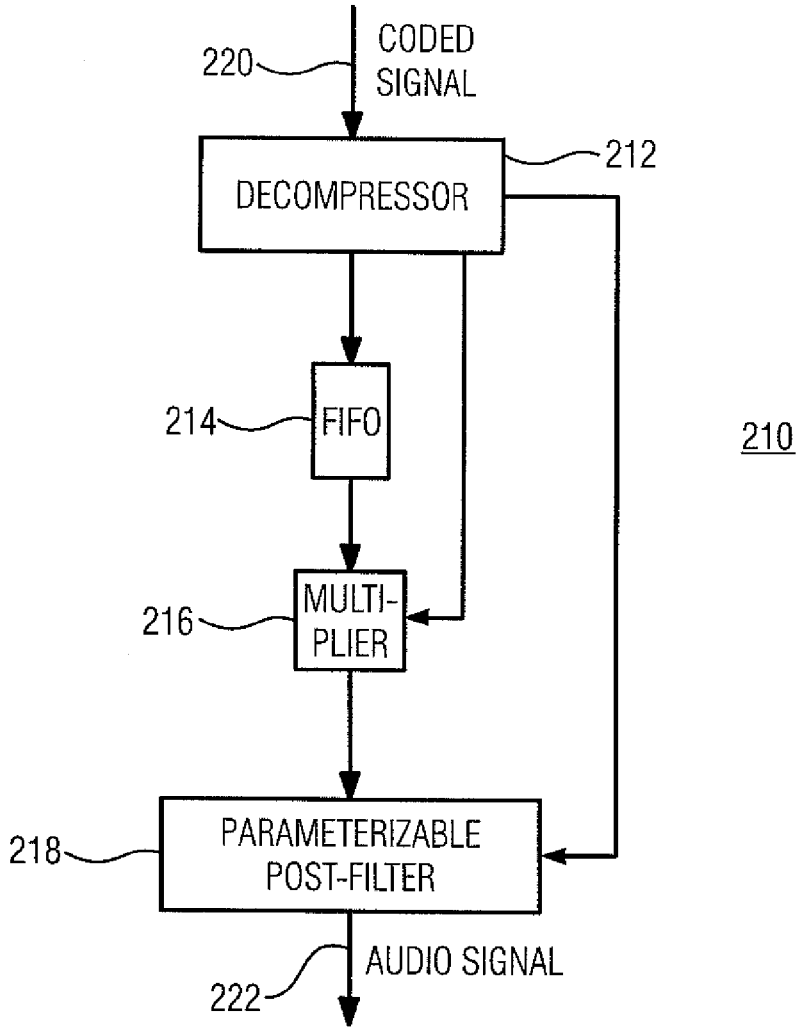
FIG. 8 shows a block circuit diagram of an audio coder which is able to decode an audio signal coded by the audio coder of FIG. 1 according to an embodiment of the present invention.

The setup of this decoder is shown in FIG. 8. The decoder generally indicated by 210 includes a decompressor 212, a FIFO memory 214, a multiplier 216 and a parameterizable post-filter 218. The decompressor 212, the FIFO memory 214, the multiplier 216 and the parameterizable post-filter 218 are connected in this order between a data input 220 and a data output 222 of the decoder 210, wherein the coded signal is received at the data input 220 and the decoded audio signal only differing from the original audio signal at the data input 12 of the audio coder 10 by the quantizing noise generated by the quantizer 28 in the audio coder 10 is output at the data output 222. The decompressor 212 is connected to a control input of the multiplier 216 at another data output to pass on a multiplicand to same, and to a parameterization input of the parameterizable post-filter 218 via another data output.

Figure 9:
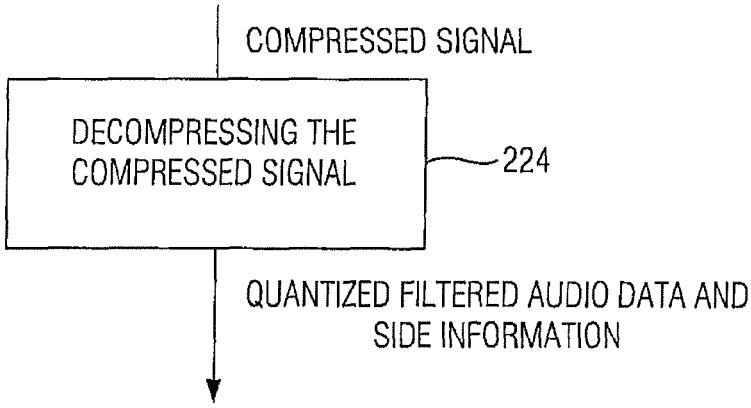
FIG. 9 shows a flow chart for illustrating the mode of functioning of the decoder of FIG. 8 at the data input.

As is shown in FIG. 9, the decompressor 212 at first decompresses in step 224 the compressed signal at the data input 220 to obtain the quantized filtered audio data, namely the sample values $\sigma'$, and the pertaining side information in the side information blocks 132, 134, which, as is known, indicate the filter coefficients and amplification values or, instead of the amplification values, the noise power limits at the nodes.

Figure 10:
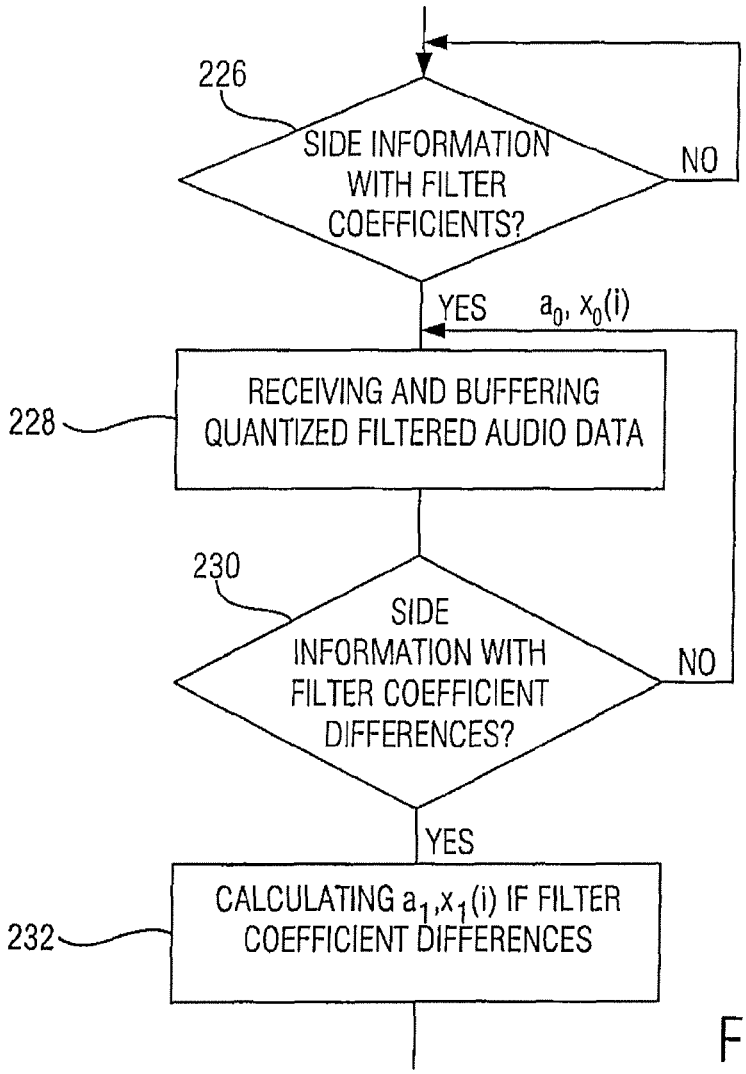
FIG. 10 shows a flow chart for illustrating the mode of functioning of the decoder of FIG. 8 with regard to buffering the pre-decoded quantized and filtered audio data and the processing of the audio blocks without corresponding side information.

As is shown in FIG. 10, the decompressor 212 checks the decompressed signal in the order of appearance in step 226 whether side information with filter coefficients is contained therein, in a self-contained form without a difference reference to a previous side information block. Put differently, the decompressor 212 looks for the first side information block 132. As soon as the decompressor 212 has found something, the quantized filtered audio values $\sigma'$ are buffered in the FIFO memory 214 in step 228. If a complete audio block of quantized filtered audio values $\sigma'$ has been stored during step 228 without a directly following side information block, it will at first be post-filtered in step 228 by means of the information contained in the side information received in step 226 on parameterization and amplification value in a post-filter and amplified in the multiplier 216, which is how it is decoded and thus the pertaining decoded audio block is achieved.

In step 230, the decompressor 212 monitors the decompressed signal for the occurrence of any kind of side information block, namely with absolute filter coefficients or filter coefficients differences to a previous side information block. In the example of FIG. 5*b*, the decompressor 212 would, for example, recognize the occurrence of the side information block 134 in step 230 upon recognizing the side information block 132 in step 226. Thus, the block of quantized filtered audio values $\sigma'(t_0)$-$\sigma'(t_{127})$ would have been decoded in step 228, using the side information 132. As long as the side information block 134 in the decompressed signal has not yet occurred, the buffering and, maybe, decoding of blocks is continued in step 228 by means of the side information of step 226, as has been described before.

As soon as the side information block 132 has occurred, the decompressor 212 will calculate the parameter values at the node 1, i.e. $a_1$, $x_1(i)$, in step 232 by adding up the difference values in the side information block 134 and the parameter values in the side information block 132. Step 232 is of course omitted if the current side information block is a self-contained side information block without differences, which, as has been described before, may exemplarily occur every second. In order for the waiting time for the decoder 210 not to be too long, side information blocks 132 where the parameter values may be derived absolutely, i.e. with no relation to another side information block, are arranged in sufficiently small distances so that the turn-on time or down time when switching on the audio coder 210 in the case of, for example, a radio transmission or broadcast transmission is not too large. Preferably, the number of side information blocks 132 arranged therebetween with the difference values are arranged in a fixed predetermined number between the side information blocks 132 so that the decoder knows when a side information block of type 132 is again to be expected in the coded signal. Alternatively, the different side information block types are indicated by corresponding flags.

Figure 11:
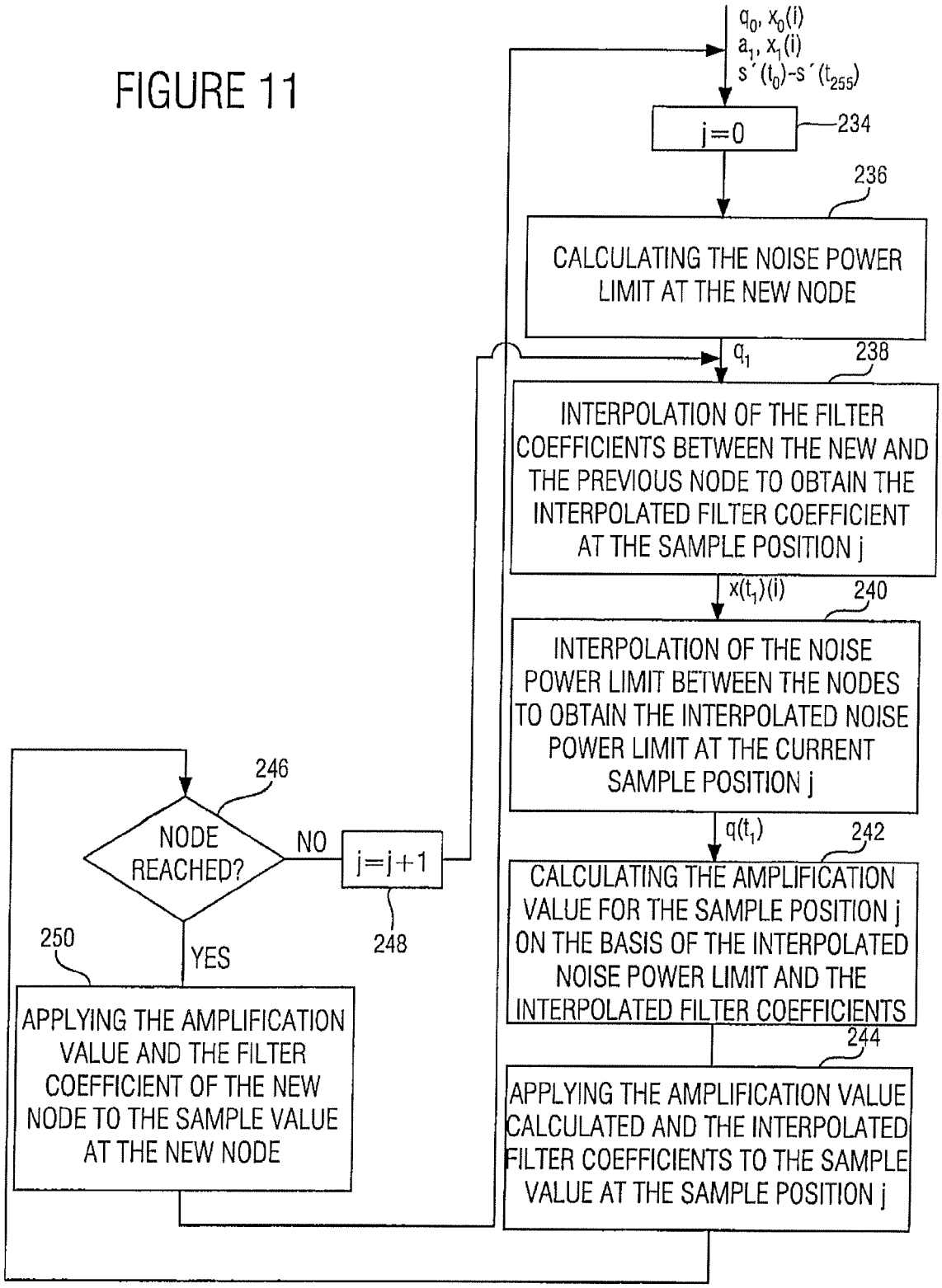
FIG. 11 shows a flow chart for illustrating the mode of functioning of the decoder of FIG. 8 with regard to the actual reverse-filtering.

As is shown in FIG. 11, after a side information block for a new node has been reached, in particular after step 226 or 232, a sample value index j is at first initialized to 0 in step 234. This value corresponds to the sample position of the first sample value in the audio block currently remaining in the FIFO 214 to which the current side information relates. Step 234 is performed by the parameterizable post-filter 218. The post-filter 218 then calculates the noise power limit at the new node in step 236, wherein this step corresponds to step 84 of FIG. 4 and may be omitted when, for example, the noise power limit at the nodes is transmitted in addition to the amplification values. In subsequent steps 238 and 240, the post-filter 218 performs interpolations with regard to the filter coefficients and the noise power limit corresponding to the interpolations 88 and 90 of FIG. 4. The subsequent calculation of the amplification value for the sample position j on the basis of the interpolated noise power limit and the interpolated filter coefficients of steps 238 and 240 in step 242 corresponds to step 92 of FIG. 4. In step 244, the post-filter 218 applies the amplification value calculated in step 242 and the interpolated filter coefficients to the sample value at the sample position j. This step differs from step 94 of FIG. 4 by the fact that the interpolated filter coefficients are applied to the quantized filtered sample values $\sigma'$ such that the transfer function of the parameterizable post-filter does not correspond to the inverse of the listening threshold, but to the listening threshold itself. In addition, the post-filter does not perform a multiplication by the amplification value, but a division by the amplification value at the quantized filtered sample values $\sigma'$ or the already reverse-filtered, quantized filtered sample value at the position j.

If the post-filter 218 has not yet reached the current node with the sample position j, which it checks in step 246, it will increment the sample position index j in step 248 and start steps 238-246 again. Only when the node has been reached, it will apply the amplification value and the filter coefficients of the new node to the sample value at the node, namely in step 250. The application in turn includes, like in step 218, a division by means of the amplification value and filtering with a transfer function equaling the listening threshold and not the inverse of the latter, instead of a multiplication. After step 250, the current audio block is decoded by an interpolation between two node parameterizations.

As has already been mentioned, the noise introduced by the quantization when coding in step 110 or 112 is adjusted in both shape and magnitude to the listening threshold by the filtering and the application of an amplification value in steps 218 and 224.

It is also to be pointed out that in the case that the quantized filtered audio values have been subjected to another multiplication in step 126 due to the bit rate controller before being coded into the coded signal, this factor may also be considered in steps 218 and 224. Alternatively, the audio values obtained by the process of FIG. 11 could of course be subjected to another multiplication to correspondingly amplify again the audio values weakened by a lower bit rate.

With regard to FIGS. 3, 4, 6 and 9-11, it is pointed out that same show flow charts illustrating the mode of functioning of the coder of FIG. 1 or the decoder of FIG. 8 and that each of the steps illustrated in the flow chart by a block, as described, is implemented in corresponding means, as has been described before. The implementation of the individual steps may be realized in hardware, as an ASIC circuit part, or in software, as subroutines. In particular, the explanations written into the blocks in these figures roughly indicate to which process the respective step corresponding to the respective block refers, whereas the arrows between the blocks illustrate the order of the steps when operating the coder and decoder, respectively.

Referring to the previous description, it is pointed out again that the coding scheme illustrated above may be varied in many regards. Exemplarily, it is not necessary for a parameterization and an amplification value or a noise power limit, as were determined for a certain audio block, to be considered as directly valid for a certain audio value, like in the previous embodiment the last respective audio value of each audio block, i.e. the 128th value in this audio block so that interpolation for this audio value may be omitted. Rather, it is possible to relate these node parameter values to a node which is temporally between the sample times $t_n$, n=0, . . . , 127, of the audio values of this audio block so that an interpolation would be necessary for each audio value. In particular, the parameterization determined for an audio block or the amplification value determined for this audio block may also be applied indirectly to another value, such as, for example, the audio value in the middle of the audio block, such as, for example, the $64^{th}$ audio value in the case of the above block size of 128 audio values.

Additionally, it is pointed out that the above embodiment referred to an audio coding scheme designed for generating a coded signal with a controlled bit rate. Controlling the bit rate, however, is not necessary for every case of application. This is why the corresponding steps 116 to 122 and 126 or 125 may also be omitted.

With reference to the compression scheme mentioned referring to step 114, for reasons of completeness, reference is made to the document by Schuller et al. described in the introduction to the description and, in particular, to division IV, the contents of which with regard to the redundancy reduction by means of lossless coding is incorporated herein by reference.

In addition, the following is to be pointed out referring to the previous embodiment. Although it has been described before that the threshold value always remains constant when quantizing or even the quantizing step function always remains constant, i.e. the artifacts generated in the filtered audio signal are always quantized or cut off by rougher a quantization, which may impair the audio quality to an audible extent, it is also possible to only use these measures if the complexity of the audio signal requires this, namely if the bit rate required for coding exceeds a desired bit rate. In this case, in addition to the quantizing step functions shown in FIGS. 7*a* and 7*b*, for example one with a quantizing step size constant over the entire range of values possible at the output of the pre-filter might be used and the quantizer would, for example, respond to a signal to use either the quantizing step function with an always constant quantizing step size or one of the quantizing step functions according to FIGS. 7*a* or 7*b* so that the quantizer could be told by the signal to perform, with little audio quality impairment, the quantizing step decrease above the threshold value or cutting off above the threshold value. Alternatively, the threshold value could also be reduced gradually. In this case, the threshold value reduction could be performed instead of the factor reduction of step 126. After a first compression trial without step 110, the temporarily compressed signal could only be subjected to a selective threshold value quantization in a modified step 126 if the bit rate were still too high (118). In another pass, the filtered audio values would then be quantized with the quantizing step function having a flatter course above the audio threshold. Further bit rate reductions could be performed in the modified step 126 by reducing the threshold value and thus by another modification of the quantization step function.

Additionally, it is pointed out that the integration of the parameters a and x into the side information block described before may also take place such that no differences are calculated but that the corresponding parameters may be derived from each side information block alone. In addition, it is not necessary to perform the quantization such that, as has been explained referring to step 110, the quantizing step size is changed from a certain upper limit on to be greater than below the upper threshold. Rather, other quantizing rules than shown in FIGS. 7*a* and 7*b* are also possible.

In summary, above embodiments used cross-fading of coefficients with regard to an audio coding scheme having a very small delay time. When coding, side information is transmitted in certain intervals. The coefficients were interpolated between the transmission times. A coefficient indicating the possible noise power or area below the masking threshold, or a value from which it may be derived was used for interpolation and, preferably, also transmitted because it had favorable characteristics in interpolation. Thus, on the one hand, the side information from the pre-filter, the coefficients of which must be transferred such that the post-filter in the decoder has the inverse transfer function so that the audio signal may again be reconstructed appropriately in the decoder could be transferred with low a bit rate by, for example, only transferring the information in certain intervals and, on the other hand, the audio quality could be maintained to a relatively good degree since the interpolation of the possible noise power as the area below the masking threshold is a good approximation for the times between the nodes.

In particular, it is pointed out that, depending on the circumstances, the inventive audio coding scheme may also be implemented in software. The implementation may be on a digital storage medium, in particular on a disc or a CD having control signals which may be readout electronically, which can cooperate with a programmable computer system such that the corresponding method will be executed. In general, the invention also is in a computer program product having a program code stored on a machine-readable carrier for performing the inventive method when the computer program product runs on a computer. Put differently, the invention may also be realized as a computer program having a program code for performing the method when the computer program runs on a computer.

In particular, above method steps in the blocks of the flow chart may be implemented individually or in groups of several ones together in subprogram routines. Alternatively, an implementation of an inventive device in the form of an integrated circuit is, of course, also possible where these blocks are, for example, implemented as individual circuit parts of an ASIC.

In particular, it is pointed out that, depending on the circumstances, the inventive scheme may also be implemented in software. The implementation may be on a digital storage medium, in particular on a disc or a CD having control signals which may be read out electronically, which can cooperate with a programmable computer system such that the corresponding method will be executed. In general, the invention thus also is in a computer program product having a program code stored on a machine-readable carrier for performing the inventive method when the computer program runs on a computer. Put differently, the invention may also be realized as a computer program having a program code for performing the method when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A device for coding an audio signal of a sequence of audio values into a coded signal, comprising:

a processor for applying a psycho-acoustic model to a first block of audio values of the sequence of audio values and a second block of audio values of the sequence of audio values;

a calculator for calculating a version of a first parameterization of a parameterizable filter based on a result of applying the psycho-acoustic model to the first block and a version of a second parameterization of the parameterizable filter based on a result of applying the psycho-acoustic model to the second block;

a determiner for determining a first noise power limit based on the result of applying the psycho-acoustic model to the first block and a second noise power limit based on the result of applying the psycho-acoustic model to the second block;

a processor for parameterizably filtering and scaling a predetermined block of audio values of the sequence of audio values to obtain a block of scaled filtered audio values corresponding to the predetermined block, comprising:

an interpolator for interpolating between the version of the first parameterization and the version of the second parameterization to obtain a version of an interpolated parameterization for a predetermined audio value in the predetermined block of audio values;

an interpolator for interpolating between the first noise power limit and the second noise power limit to obtain an interpolated noise power limit for the predetermined audio value;

a determiner for determining an intermediate scaling value depending on the interpolated noise power limit; and a processor for applying the parameterizable filter with the version of the interpolated parameterization and the intermediate scaling value to the predetermined audio values to obtain one of the scaled filtered audio values;

a quantizer for quantizing the scaled filtered audio values according to the quantizing rule to obtain a block of quantized scaled filtered audio values; and an integrator for integrating information into the coded signal, the information being indicative of the block of quantized scaled filtered audio values, the version of the first parameterization, the version of the second parameterization, the first noise power limit and the second noise power limit.

2. The device according to claim 1, wherein the processor for applying is formed as a determiner for determining a first listening threshold for the first block of audio values and a second listening threshold for the second block of audio values, the calculator for calculating is formed such that the version of the first parameterization of the parameterizable filter is calculated such that the transfer function thereof roughly corresponds to the inverse of the magnitude of the first listening threshold and the version of the second parameterization of the parameterizable filter is calculated such that the transfer function thereof roughly corresponds to the inverse of the magnitude of the second listening threshold, and the determiner for determining is formed to determine the first noise power limit depending on the first masking threshold and the second noise power limit depending on the second masking threshold.

3. The device according to claim 2, wherein the determiner for determining the first and second noise power limits is formed to determine the first noise power limit as an area below the square of the magnitude of the first listening threshold and the second noise power limit as an area below the square of the magnitude of the second listening threshold.

4. The device according to claim 2, wherein the determiner for determining an intermediate scaling value is formed to perform the determination in addition depending on a quantizing noise power caused by a certain quantizing rule.

5. The device according to claim 2, further comprising a determiner for determining a second scaling value depending on the quantizing noise power and the second noise power limit, wherein the processor for filtering and scaling further includes a processor for applying the parameterizable filter with the version of the second parameterization and the second scaling value to an audio value associated to the predetermined block to obtain one of the scaled filtered audio values.

6. The device according to claim 5, wherein the determiner for determining the first and second scaling values comprises a calculator for calculating the root of the quotient of the quantizing noise divided by the first noise power limit and the root of the quotient of the quantizing noise divided by the second noise power limit.

7. The device according to claim 2, wherein the determiner for determining the intermediate scaling value comprises a calculator for calculating the root of the quotient of the quantizing noise power divided by the interpolated noise power limit.

8. The device according to claim 2, wherein the interpolator for interpolating between the version of the first parameterization and the version of the second parameterization is formed to perform a linear interpolation.

9. The device according to claim 2, wherein the interpolator for interpolating between the first noise power limit and the second noise power limit is formed to perform a linear interpolation.

10. The device according to claim 2, wherein the quantizer for quantizing is formed to perform the quantization based on a quantization step function comprising a roughly constant quantizing step size up to a threshold value.

11. The device according to claim 2, wherein the integrator for integrating includes an entropy coder.

12. The device according to claim 2, wherein the integrator for integrating is formed such that the information represents the first or the second noise power limit or the first or the second scaling value.

13. The device according to claim 2, further comprising:

a checker for checking parameterizations following the first parameterization by the calculator for calculating one after the other as to whether they differ from the first parameterization by more than a predetermined degree, and for selecting only that among the parameterizations as the second parameterization where this is the case for the first time.

14. A method for coding an audio signal of a sequence of audio values into a coded signal, comprising the steps of:

applying a psycho-acoustic model to a first block of audio values of the sequence of audio values and a second block of audio values of the sequence of audio values;

calculating a version of a first parameterization of a parameterizable filter based on a result of applying the psycho-acoustic model to the first block and a version of a second parameterization of the parameterizable filter based on a result of applying the psycho-acoustic model to the second block;

determining a first noise power limit based on the result of applying the psycho-acoustic model to the first block and a second noise power limit based on the result of applying the psycho-acoustic model to the second block;

parameterizably filtering and scaling a predetermined block of audio values of the sequence of audio values to obtain a block of scaled filtered audio values corresponding to the predetermined block, comprising the following substeps:

interpolating between the version of the first parameterization and the version of the second parameterization to obtain a version of an interpolated parameterization for a predetermined audio value in the predetermined block of audio values;

interpolating between the first noise power limit and the second noise power limit to obtain an interpolated noise power limit for the predetermined audio value;

determining an intermediate scaling value depending on the interpolated noise power limit; and applying the parameterizable filter with the version of the interpolated parameterization and the intermediate scaling value to the predetermined audio value to obtain one of the scaled filtered audio values;

quantizing the scaled filtered audio values to obtain a block of quantized scaled filtered audio values; and integrating information into the coded signal, the information being indicative of the block of quantized scaled filtered audio values, the version of the first parameterization, the version of the second parameterization, the first noise power limit and the second noise power limit.

15. A device for decoding a coded signal into a decoded audio signal, wherein the coded signal contains information indicative of a predetermined block of quantized scaled filtered audio values, a version of a first parameterization, a version of a second parameterization, a first noise power limit and a second noise power limit, comprising:

a deriver for deriving the predetermined block of quantized scaled filtered audio values, the version of the first parameterization, the version of the second parameterization, the first noise power limit and the second noise power limit from the coded signal;

a processor for parameterizably filtering and scaling the predetermined block of quantized scaled filtered audio values to obtain a corresponding block of decoded audio values, comprising:

an interpolator for interpolating between the version of the first parameterization and the version of the second parameterization to obtain a version of an interpolated parameterization for a predetermined audio value in the block of quantized scaled filtered audio values;

an interpolator for interpolating between the first noise power limit and the second noise power limit to obtain an interpolated noise power limit for the predetermined audio value;

a determiner for determining an intermediate scaling value depending on the interpolated noise power limit; and a processor for applying the parameterizable filter with the version of the interpolated parameterization and the intermediate scaling value to the predetermined audio value to obtain one of the decoded audio values.

16. A method for decoding a coded signal into a decoded audio signal, the coded signal containing information indicative of a predetermined block of quantized scaled filtered audio values, a version of a first parameterization, a version of a second parameterization, a first noise power limit and a second noise power limit, comprising the steps of:

deriving the predetermined block of quantized scaled filtered audio values, the version of the first parameterization, the version of the second parameterization, the first noise power limit and the second noise power limit from the coded signal;

parameterizably filtering and scaling the predetermined block of quantized scaled filtered audio values to obtain a corresponding block of decoded audio values, comprising the following substeps:

interpolating between the version of the first parameterization and the version of the second parameterization to obtain a version of an interpolated parameterization for a predetermined audio value in the block of quantized scaled filtered audio values;

interpolating between the first noise power limit and the second noise power limit to obtain an interpolated noise power limit for the predetermined audio value;

determining an intermediate scaling value depending on the interpolated noise power limit; and applying the parameterizable filter with the version of the interpolated parameterization and the intermediate scaling value to the predetermined audio value to obtain one of the decoded audio values.

17. A computer program product having a program code stored on a non-transitory machine-readable medium for performing a method for coding an audio signal of a sequence of audio values into a coded signal, comprising the steps of: applying a psycho-acoustic model to a first block of audio values of the sequence of audio values and a second block of audio values of the sequence of audio values; calculating a version of a first parameterization of a parameterizable filter based on a result of applying the psycho-acoustic model to the first block and a version of a second parameterization of the parameterizable filter based on a result of applying the psycho-acoustic model to the second block; determining a first noise power limit based on the result of applying the psycho-acoustic model to the first block and a second noise power limit based on the result of applying the psycho-acoustic model to the second block; parameterizably filtering and scaling a predetermined block of audio values of the sequence of audio values to obtain a block of scaled filtered audio values corresponding to the predetermined block, comprising the following substeps: interpolating between the version of the first parameterization and the version of the second parameterization to obtain a version of an interpolated parameterization for a predetermined audio value in the predetermined block of audio values; interpolating between the first noise power limit and the second noise power limit to obtain an interpolated noise power limit for the predetermined audio value; determining an intermediate scaling value depending on the interpolated noise power limit; and applying the parameterizable filter with the version of the interpolated parameterization and the intermediate scaling value to the predetermined audio value to obtain one of the scaled filtered audio values; quantizing the scaled filtered audio values to obtain a block of quantized scaled filtered audio values; and integrating information into the coded signal, the information being indicative of the block of quantized scaled filtered audio values, the version of the first parameterization, the version of the second parameterization, the first noise power limit and the second noise power limit, when the computer program runs on a computer.

18. A computer program product having a program code stored on a non-transitory machine-readable medium for performing a method for decoding a coded signal into a decoded audio signal, the coded signal containing information indicative of a predetermined block of quantized scaled filtered audio values, a version of a first parameterization, a version of a second parameterization, a first noise power limit and a second noise power limit, comprising the steps of: deriving the predetermined block of quantized scaled filtered audio values, the version of the first parameterization, the version of the second parameterization, the first noise power limit and the second noise power limit from the coded signal; parameterizably filtering and scaling the predetermined block of quantized scaled filtered audio values to obtain a corresponding block of decoded audio values, comprising the following substeps: interpolating between the version of the first parameterization and the version of the second parameterization to obtain a version of an interpolated parameterization for a predetermined audio value in the block of quantized scaled filtered audio values; interpolating between the first noise power limit and the second noise power limit to obtain an interpolated noise power limit for the predetermined audio value; determining an intermediate scaling value depending on the interpolated noise power limit; and applying the parameterizable filter with the version of the interpolated parameterization and the intermediate scaling value to the predetermined audio value to obtain one of the decoded audio values, when the computer program runs on a computer.

* * * * *